US007859368B2

(12) United States Patent
Huang et al.

(10) Patent No.: US 7,859,368 B2
(45) Date of Patent: Dec. 28, 2010

(54) CIRCUIT INTERRUPTING DEVICE WITH AUTOMATIC COMPONENTS DETECTION FUNCTION

(75) Inventors: Huadao Huang, Room 501, Block 10, No. 137, Shuang Long Rd., Wenzhou (CN) 325000; Lu Huayang, Shanghai (CN)

(73) Assignee: Huadao Huang (CN)

( * ) Notice: Subject to any disclaimer, the term of this patent is extended or adjusted under 35 U.S.C. 154(b) by 583 days.

(21) Appl. No.: 11/987,902

(22) Filed: Dec. 5, 2007

(65) Prior Publication Data

US 2009/0091869 A1 Apr. 9, 2009

(30) Foreign Application Priority Data

Oct. 7, 2007 (CN) ..... 2007 2 0169660 U

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 73/00*** | (2006.01) |
| ***H01H 83/06*** | (2006.01) |

(52) U.S. Cl. ..... 335/18; 335/6

(58) Field of Classification Search ..... 335/6, 335/18

See application file for complete search history.

(56) References Cited

U.S. PATENT DOCUMENTS

| | | | |
|---|---|---|---|
| 4,315,328 | A | 2/1982 | Schwab |
| 4,386,338 | A | 5/1983 | Doyle et al. |
| 4,518,945 | A | 5/1985 | Doyle et al. |
| 4,595,894 | A | 6/1986 | Doyle et al. |
| 4,831,496 | A | 5/1989 | Brant et al. |
| 5,202,662 | A | 4/1993 | Bienwald et al. |
| 5,594,398 | A | 1/1997 | Marcou et al. |
| 5,654,857 | A | 8/1997 | Gershen |
| 5,680,287 | A | 10/1997 | Gernhardt et al. |
| 5,963,408 | A | 10/1999 | Neiger et al. |
| 6,040,967 | A | 3/2000 | DiSalvo |
| 6,052,265 | A | 4/2000 | Zaretsky et al. |
| 6,111,733 | A | 8/2000 | Neiger et al. |
| 6,226,161 | B1 | 5/2001 | Neiger et al. |
| 6,246,558 | B1 | 6/2001 | DiSalvo et al. |
| 6,252,407 | B1 | 6/2001 | Gershen |
| 6,282,070 | B1 | 8/2001 | Ziegler et al. |
| 6,288,882 | B1 | 9/2001 | DiSalvo et al. |
| 6,309,248 | B1 | 10/2001 | King |
| 6,381,112 | B1 | 4/2002 | DiSalvo |
| 6,437,953 | B2 | 8/2002 | DiSalvo et al. |
| 6,469,881 | B2 | 10/2002 | Gershen et al. |

(Continued)

*Primary Examiner*—Elvin G Enad
*Assistant Examiner*—Alexander Talpalatskiy
(74) *Attorney, Agent, or Firm*—Andrews Kurth LLP

(57) ABSTRACT

The present invention provides a circuit interrupting device which contains four pairs of contacts to electrically connect/disconnect to an input power source to a user accessible load and an output power end. The present invention also provides a simulated leakage current generating switch, which is capable of automatically generating a simulated current to test the circuit interrupting device when the power lines are properly wired and in a tripped state. The present invention further provides a reset switch which allows reset when the power lines are properly wired and the reset button is depressed. In addition, the present invention provides a dual-functioned test button which can manually generate a simulated leakage current when a first-level test button is depressed, and can perform a mechanical trip when a second-level test button is depressed.

25 Claims, 20 Drawing Sheets

U.S. PATENT DOCUMENTS 6,580,344 B2 6/2003 Li
6,671,145 B2 12/2003 Germain et al.
6,864,766 B2 3/2005 DiSalvo et al.
6,952,150 B2 10/2005 Radosavljevic et al.
6,958,895 B1 10/2005 Radosavljevic et al.
6,963,260 B2 11/2005 Germain et al.
7,019,952 B2 3/2006 Huang et al.
7,049,910 B2 5/2006 Campolo et al.
7,049,911 B2 5/2006 Germain et al.
7,068,481 B2 6/2006 Radosavljevic et al.
7,116,191 B2 * 10/2006 Wang ..... 335/18
7,154,718 B1 12/2006 Finlay, Sr. et al.
7,195,500 B2 * 3/2007 Huang et al. ..... 439/107
7,212,386 B1 5/2007 Finlay, Sr et al.
7,265,956 B2 * 9/2007 Huang ..... 361/42
7,271,987 B1 * 9/2007 Zhang et al. ..... 361/42
7,283,340 B1 10/2007 Finlay, Sr. et al.
7,315,227 B2 * 1/2008 Huang et al. ..... 335/6
7,408,432 B2 * 8/2008 Shi ..... 335/17
7,498,909 B2 * 3/2009 Zhang et al. ..... 335/18
2004/0070474 A1 * 4/2004 Wu et al. ..... 335/18
2006/0193092 A1 * 8/2006 Huang et al. ..... 361/42

* cited by examiner

CIRCUIT INTERRUPTING DEVICE WITH AUTOMATIC COMPONENTS DETECTION FUNCTION

RELATED APPLICATION

This application claims the priority of Chinese patent application No. 200720169660.8, which was filed on Oct. 7, 2007, which is herein incorporated by reference.

FIELD OF THE INVENTION

The present invention relates to a circuit interrupting device which contains four pairs of contacts to electrically connect/disconnect to an input power source to a user accessible load and an output power end. The present invention also relates to a simulated leakage current generating switch, which is capable of automatically generating a simulated current to test the circuit interrupting device when the power lines are properly wired. The present invention further relates to a reset switch which allows reset when the power lines are properly wired and the reset button is depressed. In addition, the present invention relates to a dual-functioned test button which can manually generate a simulated leakage current when a first-level test button is depressed, and can perform a mechanical trip when a second-level test button is depressed.

BACKGROUND OF THE INVENTION

Ground fault circuit interrupter (GFCI) devices are required in most residential and commercial applications where a possible wiring defect or other electrical fault could expose a consumer to shock or electrocution. GFCI devices, like any electromechanical device, can experience an end-of-life condition when the device's internal components fail and lose their protective functions.

In the invention to be described below, a novel ground fault circuit interrupter is introduced, which is capable of automatically generating a simulated leakage current when certain conditions are met.

SUMMARY OF THE INVENTION

The present invention provides a circuit interrupting device, preferably a ground fault circuit interrupter (GFCI), which comprises (1) a pair of power output conductors extended to electrically connect to user accessible load ends; (2) a first pair of flexible metal pieces where an end of each of the first pair of flexible metal pieces is obliquely connected to a printed circuit board and further electrically connected to a metal piece, which is electrically connected to said input power source, and where another end of each of the first pair of flexible metal pieces is capable of connecting/disconnecting to each of the pair of power output conductors; (3) a second pair of flexible metal pieces where an end of each of the second pair of flexible metal pieces is electrically connected to the output power source and where another end of each of the second pair of flexible metal pieces is capable of connecting/disconnecting to each of said pair of power output conductors. An electrical continuity is established or discontinued when the first pair of flexible metal pieces is connecting/disconnecting to the pair of power output conductors, and the second pair of flexible metal pieces is connecting/disconnecting to the pair of power output conductors.

Each of the pair of power output conductors comprises a pair of fixed contacts. The pair of fixed contacts on each of said pair of output conductors is perpendicular to said power output conductors. Each of the first pair of flexible metal pieces has a movable contact which is capable of connecting/disconnecting to each of the fixed contacts on the pair of power output conductors. Each of the second pair of flexible metal pieces has a movable contact which is capable of connecting/disconnecting to each of the fixed contacts on the pair of power output conductors.

The metal piece that is capable of electrically connecting to one of the first pair of flexible metal piece is preferably in a U-shape and can pass through a differential transformer.

The circuit interrupting device further comprises a tripping mechanism, which is located underneath a reset button. The tripping mechanism comprises a reset support piece and a tripping device. The reset support piece is located above the tripping device which provides supports for the first and the second pairs of flexible metal pieces. The tripping device moves when the reset button is depressed. The reset support piece is shaped like a "I", where a top dimension of the reset support piece is smaller than a bottom dimension. Each of the first and the second pairs of flexible metal pieces further comprises a semicircular protruding piece which allows the first and the second pairs of the flexible metal pieces to sit on top of the reset support piece.

The reset support piece and the tripping device contain through holes which are aligned to allow a directional lock from underneath the reset button to pass through. The directional lock is capable of passing through a hole in a locking member, which penetrates through the middle section of the tripping device when a rest button is depressed and the solenoid coil is energized to reset the circuit interrupting device.

The circuit interrupting device further comprises a reset status light that lights when the device is capable of being reset; and a power status light that lights to indicate that the device has power output.

The present invention further provides a circuit interrupting device which comprises a simulated leakage current generating switch (KR-1) which contains a first switch piece; a second switch piece; and a third switch piece. When the circuit interrupting device is properly wired and in a tripped state, the first switch piece is in contact with the second switch piece, which automatically generates a simulated leakage current to test the components of the circuit interrupting device. If all of the components tested are working properly, the circuit interrupting device can be reset.

The first switch piece is in series with a resistor which is electrically connected to a neutral line of said input power source. The first switch piece has a contact located at an upper end of the first switch piece. The second switch piece is electrically connected to a hot line of the input power source via a solenoid coil. The second switch piece has two contacts located at an upper and a lower ends of the second switch piece. The third switch piece is electrically connected to the neutral line of the input power source through a silicon controlled rectifier (SCR). The third switch piece has a contact located at a lower end of said third switch piece. The first, second, and third switch pieces are located next to a tripping device beneath the reset button and are triangularly arranged with the first switch piece located at the bottom, the second switch piece situated in the middle, and the third switch piece located at the top.

The components of the circuit interrupting device that can be tested due to the simulated leakage current are preferably SCR and solenoid coil, and further include a differential transformer and a leakage current detection IC chip.

The circuit interrupting device further comprises a reset status light that lights when the device is capable of being reset; and a power status light that lights to indicate that the device has power output.

In addition, the present invention provides a circuit interrupting device which comprises a reset switch (KR-4) which is located below a reset button. The reset switch comprises a flexible metal piece and an electric contact. When the reset button is in a tripped state, the flexible metal piece and the electric contact do not come into contact so that the reset switch is in a disconnected state. When the power lines are properly wired and the reset button is depressed, the flexible metal piece and the electric contact come into contact with each other to allow reset. The reset switch is coupled to a solenoid coil and is serially connected to a simulated leakage current generating switch. The circuit interrupting device further comprises a reset status light that lights when the device is capable of being reset; and a power status light that lights to indicate that the device has power output.

Finally, the present invention provides a circuit interrupting device which comprises a dual-function test button which provides a manual test of components of the circuit interrupting device when a first-level test button is depressed, and provides a mechanical tripping mechanism when a second-level test button is depressed.

The test button has an arm extended downward to connect to a sliding block and a test switch (KR-5). The test switch comprises a first flexible metal switch piece and a second flexible metal switch piece. When the interrupting device is properly wired (i.e., that the device is powered) and in the reset state, a depression of the test button at the first-level causes the test switch to be activated to manually test the components of the interrupting device. When the circuit interrupting device is not properly wired and in a reset state, a depression of the test button at the second-level allows the sliding block to rotate to manually cause the circuit interrupting device to trip.

One end of the first flexible metal switch piece of the test switch is electrically connected to one power output end (e.g., the hot power output end) and the other end is suspended in the air. One end of the second flexible metal switch of the test switch is electrically connected to the other power input end (e.g., the neutral power input end) through a resistor, and the other end is suspended in the air. When the test button is depressed, the first flexible metal switch piece is in contact with the second flexible metal switch piece to initiate a test of the circuit interrupting device.

The sliding block has a pair of protrusions on two sides that act as rotating axles. It further has an handle which is adapted to connect to a locking member of a tripping device in connection with the reset button. When the test button is depressed at a second-level, the sliding block mechanically moves the locking member so as to mechanically trip the circuit interrupting device. The circuit interrupting device further comprises a reset status light that lights when the device is capable of being reset; and a power status light that lights to indicate that the device has power output.

BRIEF DESCRIPTION OF THE DRAWINGS

The detailed description will refer to the following drawings in which like numerals refer to like items, and in which:

FIG. 7-1 is a partial cross-sectional view along the B-B line in FIG. 3 illustrating relationships among the parts when the GFCI device works initially with no power output;

FIG. 7-2 is a partial cross-sectional view along the B-B line in FIG. 3 illustrating relationships among the parts the instant the reset button is pressed;

FIG. 7-3 is a partial cross-sectional view along the B-B line in FIG. 3 illustrating relationships among the parts when the reset button is reset and the GFCI device works normally with power output;

FIG. 8-1 is a partial cross-sectional view along the B-B line in FIG. 3 illustrating relationships among the parts when the GFCI is reset with power output in the outlets of the user accessible load;

FIG. 8-2 is a partial cross-sectional view along the B-B line in FIG. 3 illustrating relationships among the parts when the test button is pressed, the GFCI device works normally, and the reset button is released with no power output from the GFCI device;

FIG. 8-3 is a partial cross-sectional view along the B-B line in FIG. 3 illustrating relationships among the parts when the test button is pressed, the GFCI device has come to the end of its life, and the reset button does not trip/release and the GFCI device still has power output;

FIG. 8-4 is a partial cross-sectional view along the B-B line in FIG. 3 illustrating relationships among the parts when the GFCI is at the reset position and the test button has been repeatedly pressed to force a mechanical trip so as to disconnect the power to the user accessible load;

FIG. 9-1 is a partial cross-sectional view along the C-C line in FIG. 3 illustrating relationships among the parts when the test button is pressed, the GFCI device has come to the end of its life, and the reset button does not trip/release and the GFCI device still has a power output;

FIG. 9-2 is a partial cross-sectional view along the C-C line in FIG. 3 illustrating relationships among the parts when the GFCI is at the reset position and the test button has been repeatedly pressed to force a mechanical trip so as to disconnect the power to the user accessible load;

FIG. 10-1 is a partial cross-sectional view along the A-A line in FIG. 3 illustrating relationships among the parts when the reset button is in a released state;

FIG. 10-2 is a partial cross-sectional view along the A-A line in FIG. 3 illustrating relationships among the parts the instant the reset button is pressed;

FIG. 10-3 is a partial cross-sectional view along the A-A line in FIG. 3 illustrating relationships among the parts the instant when the reset button is in a reset state;

DETAILED DESCRIPTION OF THE INVENTION

Ground fault circuit interrupter (GFCI) devices are required in most residential and commercial applications where a possible wiring defect or other electrical fault could expose a consumer to shock or electrocution. GFCI devices, like any electro-mechanical device, can experience an end-of-life condition when the device's internal components fail and lose their protective functions. However, current GFCI devices lack an end of life test function. In addition, when they reach an end of life condition, these GFCI devices do not have any mechanism for indicating that condition to a user. The reset buttons of these end of life GFCI devices may still be reset. The load output ends and the single phase, three line output sockets on the surfaces of these GFCI devices will still have a power output, misleading users into continuing to use the GFCI devices. When there is a leakage current, such an end of life GFCI device cannot provide its normal protective functions, thereby increasing the risk to the user of electrical shock and electrocution.

In addition, some of the current GFCI devices do not include mechanisms that prevent reverse wiring errors. When an installer erroneously connects the hot power line and neutral power line inside a wall to the power output ends of a current GFCI devices, the single phase, three line output socket on the surface of the device has a power output, but the current flowing through the device does not flow through the electric leakage current protection circuit installed inside the device. Therefore, when reversed wired, the GFCI device cannot protect against electric leakage current, and when such electric leakage current exists, the user is exposed to an increased risk of electric shock and electrocution.

Figure 1:
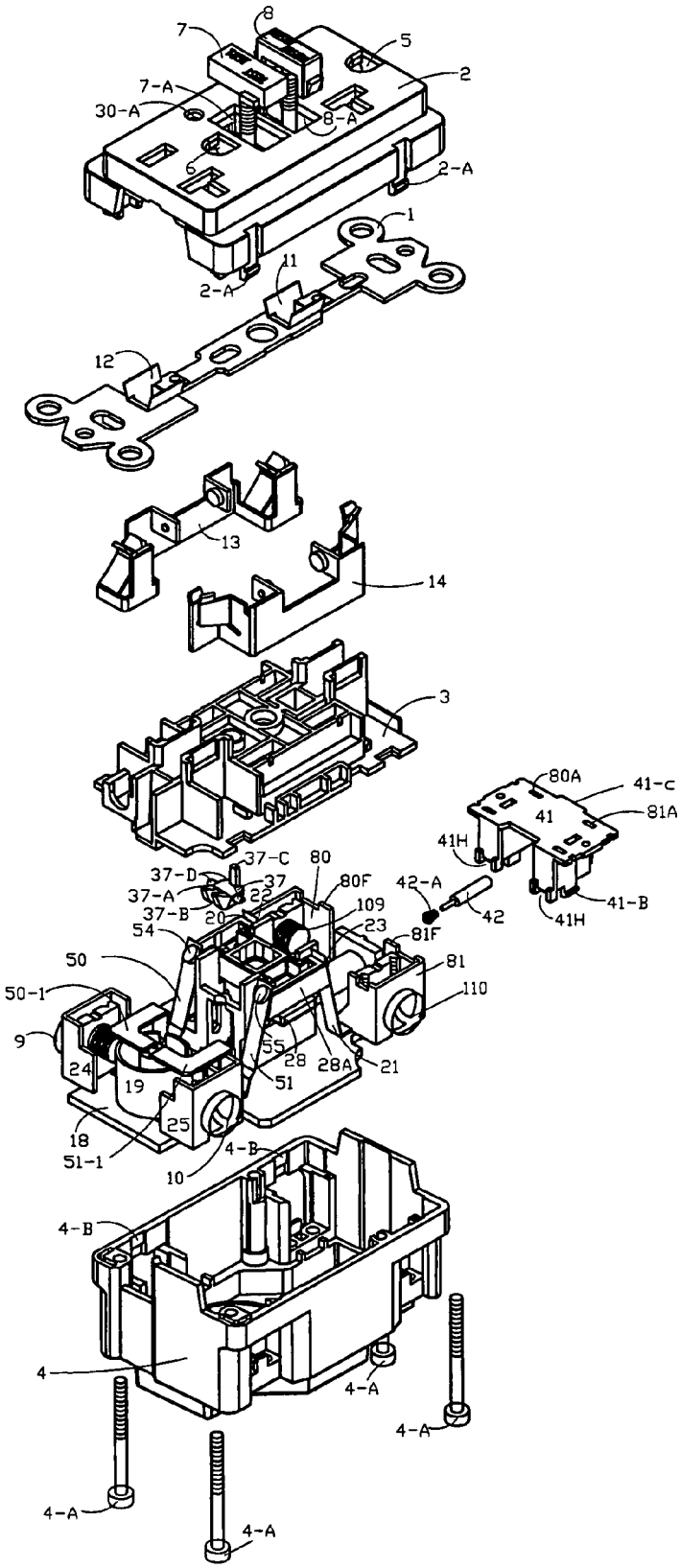
FIG. 1 is an exploded cubic schematic of the structure of an embodiment of a GFCI device.

FIG. 1 is an exploded view of an embodiment of an improved GFCI device that addresses the aforementioned limitations of current GFCI devices by incorporating end of life and reverse wiring features. Although FIG. 1 shows a GFCI device, the disclosed end of life and reverse wiring protective features also could be incorporated into an arc fault circuit interrupter, an immersion detection circuit interrupter, an appliance leakage circuit interrupter, and a circuit breaker, for example.

The GFCI device of FIG. 1 includes a housing and a circuit board 18 installed inside the housing capable of achieving a ground fault circuit interruption with or without a power output from the GFCI device. The GFCI housing includes a combination of upper cover 2, insulated middle support 3 and base 4. Metal mounting strap 1 is positioned between upper cover 2 and middle support 3. The circuit board 18 is positioned between the insulated middle support 3 and the base 4.

Figure 2:
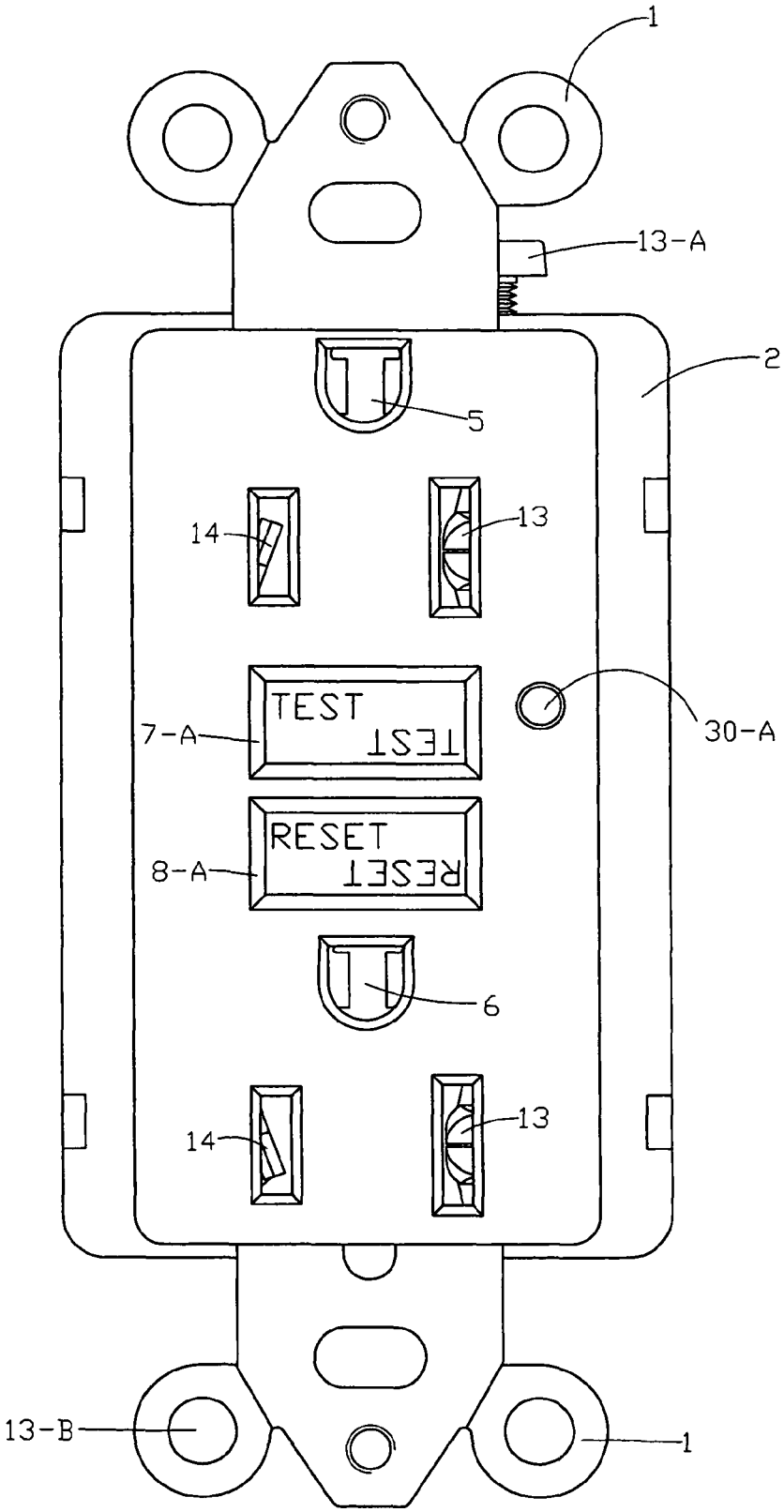
FIG. 2 is the main view of the GFCI device of FIG. 1.

As shown in FIGS. 1 and 2, power output sockets 5, 6, reset button hole 8-A, test button hole 7-A, and status indicating light hole 30-A are formed on the upper cover 2. Reset button (RESET) 8 and test button (TEST) 7 are installed in reset button hole 8-A and test button hole 7-A, respectively. Reset button 8 and test button 7 penetrate through metal mounting strap 1 and insulated middle support 3 to make contact with circuit board 18 components. Four hooks 2-A are arranged on the side of the upper cover 2 to hook into slots 4-B on base 4.

Metal mounting strap 1 is grounded through grounding screw 13-A (as shown in FIGS. 1 and 2). Grounding pieces 11, 12 are arranged on metal mounting strap 1 at locations corresponding to the grounding holes of power output sockets 5, 6 of the upper cover 2.

Figure 3:
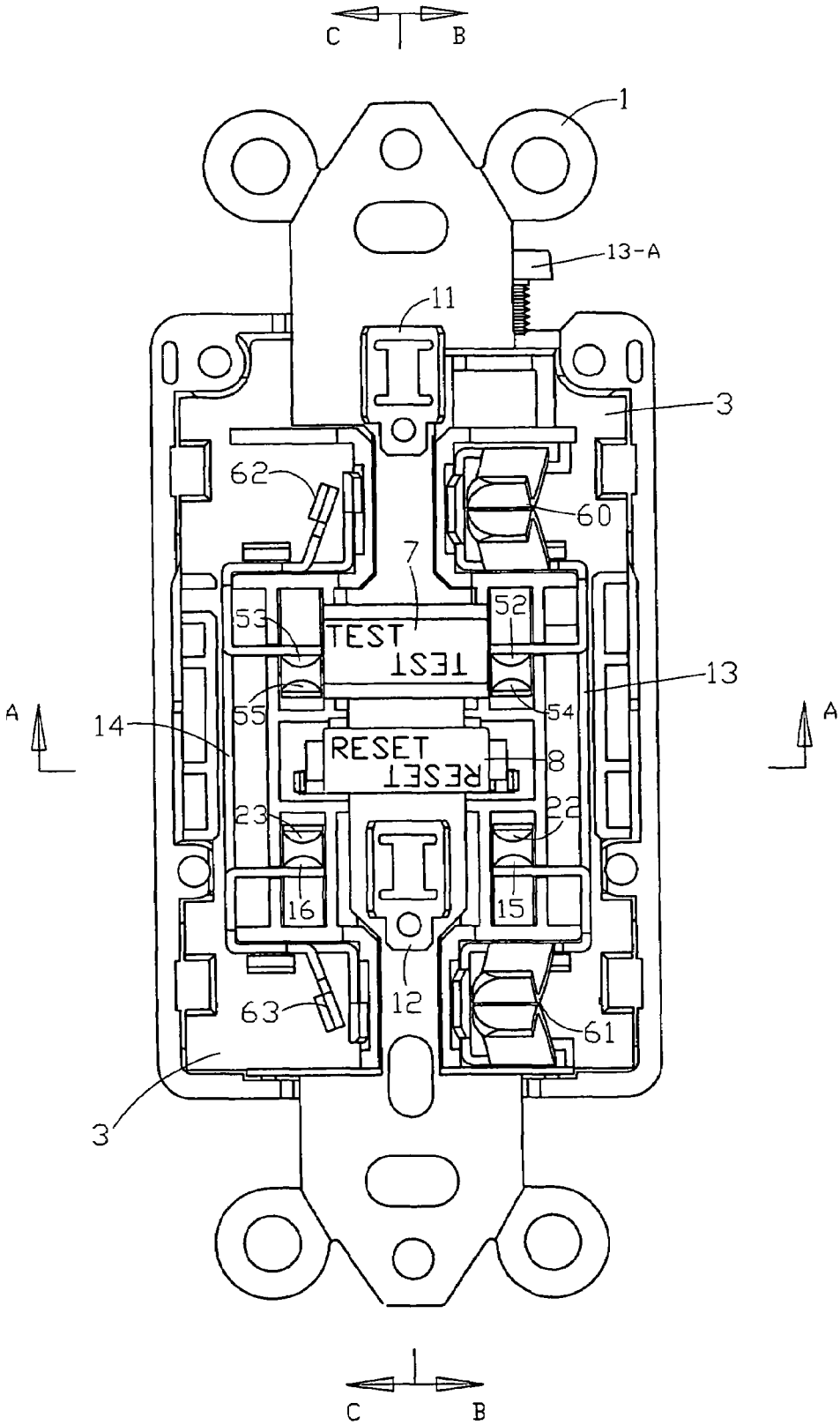
FIG. 3 is the front view of the GFCI device of FIG. 1 with the upper cover removed.

As shown in FIGS. 1 and 3, a hot power output conductor 14 and a neutral power output conductor 13 are installed on the two sides of the insulated middle support 3. At the two ends of power output conductors 13, 14, gripping wing pieces 60, 61, 62, 63 are arranged at places corresponding to the hot and neutral holes of power output sockets 5, 6 on the upper cover 2. As shown in FIGS. 1, 3, 4, and 7-1, on both ends of neutral power output conductor 13, using the center of the tripping device on circuit board 18 as a center point, at locations greater than the width of tripping device 28 and perpendicular to the body of neutral power output conductor 13, side walls extend horizontally. As shown in FIGS. 1, 3, 4, and 9-1, on hot power line output conductor 14, using the center of the tripping device on circuit board 18 as a center point, at locations greater than the width of tripping device 28 and perpendicular to the body of hot power line output conductor 14, side walls extend horizontally. Fixed contacts 15, 52 and 16, 53 are arranged on side walls of power output conductors 13 and 14, respectively, to form two pairs of fixed contacts 15, 16 and 52, 53.

As shown in FIG. 1, base 4 is used to accommodate insulated middle support 3 and circuit board 18. A pair of neutral and hot power input wiring screws 9, 10 and a pair of neutral and hot power output wiring screws 109, 110 are installed symmetrically on the two sides of base 4.

The circuit board 18 functions to cause power outlet sockets 5 and 6 on the upper cover 2 of the GFCI device and power output wiring screw 109 and 110 on the sides of the base 4 to have or not to have power output. The circuit board 18 also functions to test whether the GFCI device has come to the end of its life, display the test result, and to forcibly release the GFCI device through mechanical means, and to prevent reverse wiring errors.

Figure 4:
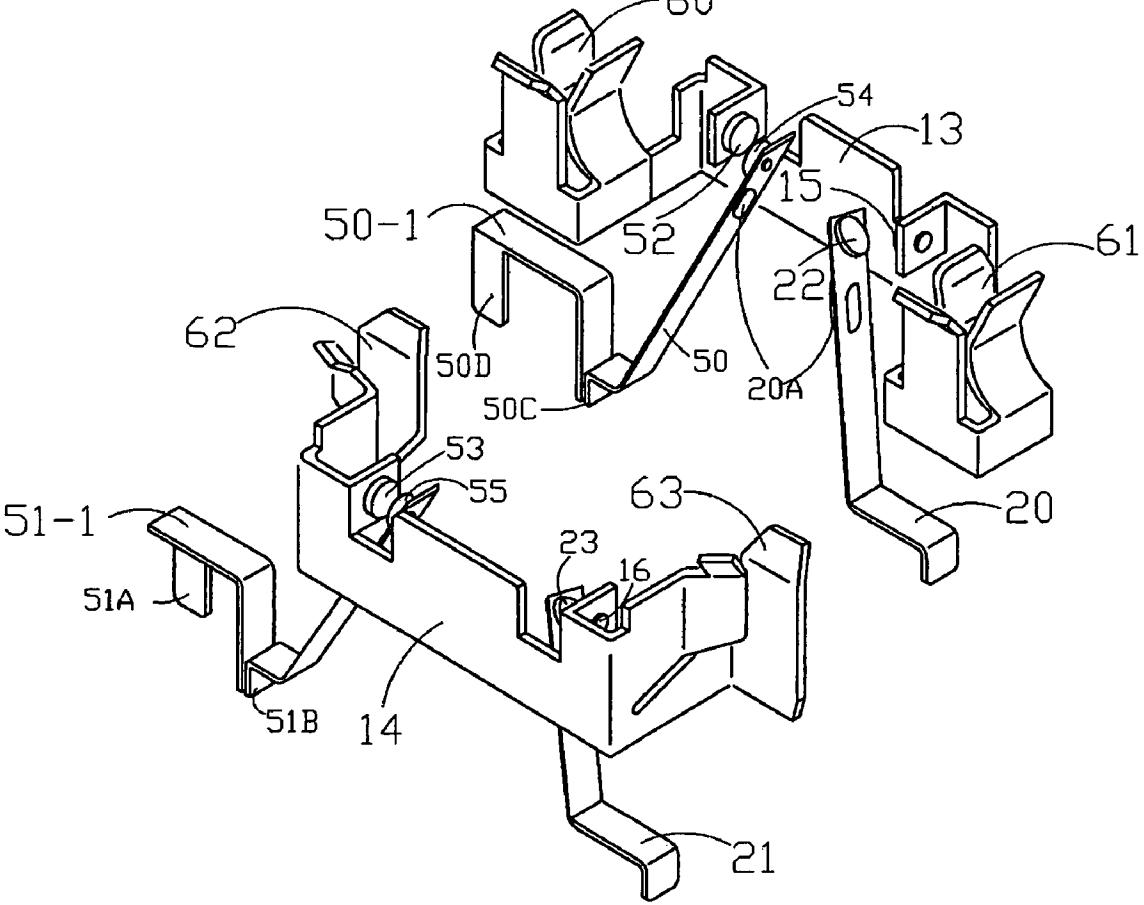
FIG. 4 is an illustration of the relationships among the power input metal pieces, power output conductors, and flexible connecting output metal pieces of the GFCI device of FIG. 1.

As shown in FIGS. 1, 4, 5 and 7-1, obliquely placed, flexible neutral power line and hot power line input metal pieces 50 and 51 are placed on circuit board 18. One end 50C of obliquely placed flexible neutral power line input metal piece 50 is welded onto one end of "U" shaped neutral power line input metal connecting piece 50-1. The other end is inclined upward. A moving contact 54 is placed in the end section of the upwardly inclined end, at a location corresponding to fixed contact 52 on neutral power output conductor 13. The other end 50D of "U" shaped neutral power line input metal connecting piece 50-1 threads through differential transformer 19, and is welded onto circuit board 18 together with metal piece 24. The welded together parts 24 and 50D then connect to a neutral power line input wiring screw 9. Neutral power line input wiring screw 9 connects to a neutral power source. Similarly, as shown in FIGS. 1, 4, 5, and 9-1, one end 51B of obliquely placed, flexible hot power line input metal piece 51 is welded onto one end of "U" shaped the hot power line input metal connecting piece 51-1. The other end is inclined upward. A moving contact 55 is placed in the end section of the piece 51-1, at a location corresponding to fixed contact 53 on the hot power line output conductor 14. The other end 51A of "U" shaped hot power line input metal connecting piece 51-1 threads through differential transformer 19 and is welded together with metal piece 25 onto circuit board 18. The welded together parts 25 and 51A then connect to a hot power line input wiring screw 10. Hot power line input wiring screw 10 is connected to the hot power source. As shown in FIGS. 3 and 4, moving contacts 54 and 55 on flexible power input metal pieces 50 and 51, respectively, correspond to fixed contacts 52 and 53, respectively placed on power output conductors 13 and 14 on middle support 3, with which they form two pairs of hot line and neutral line power switches.

Figure 5:
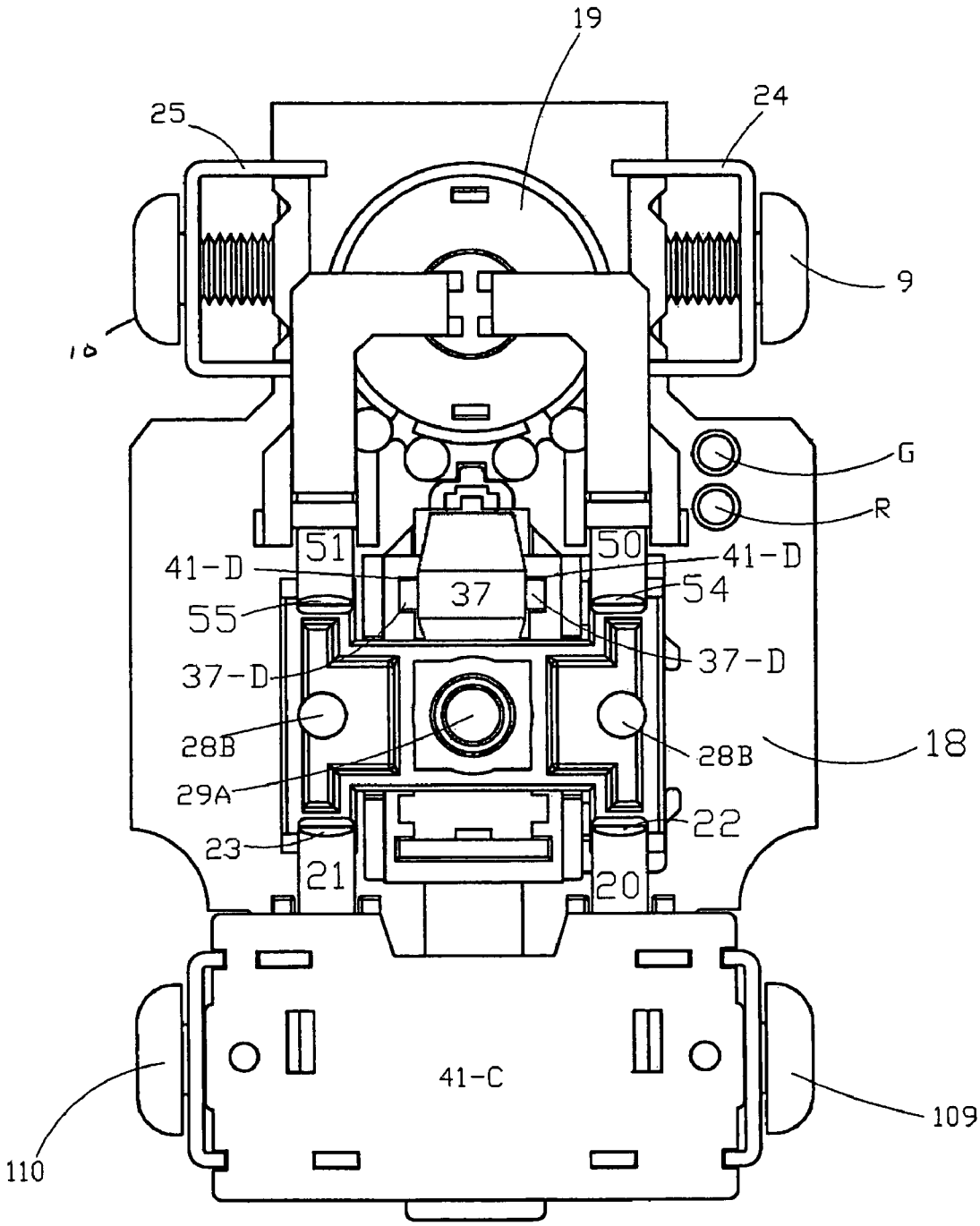
FIG. 5 is an illustration of the relationships among the parts on the circuit board of the GFCI device of FIG. 1.
Figures 1, 7:
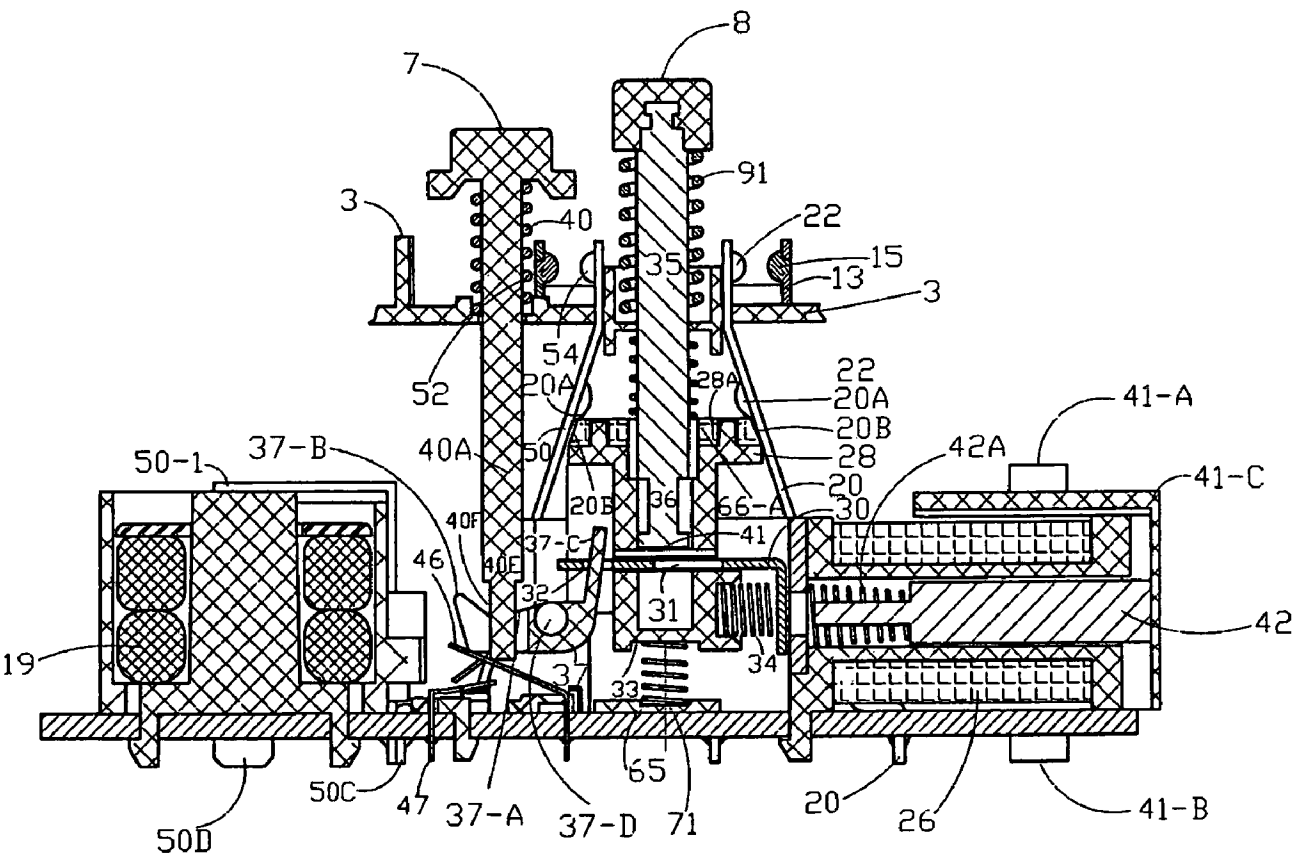
Figures 2, 7:
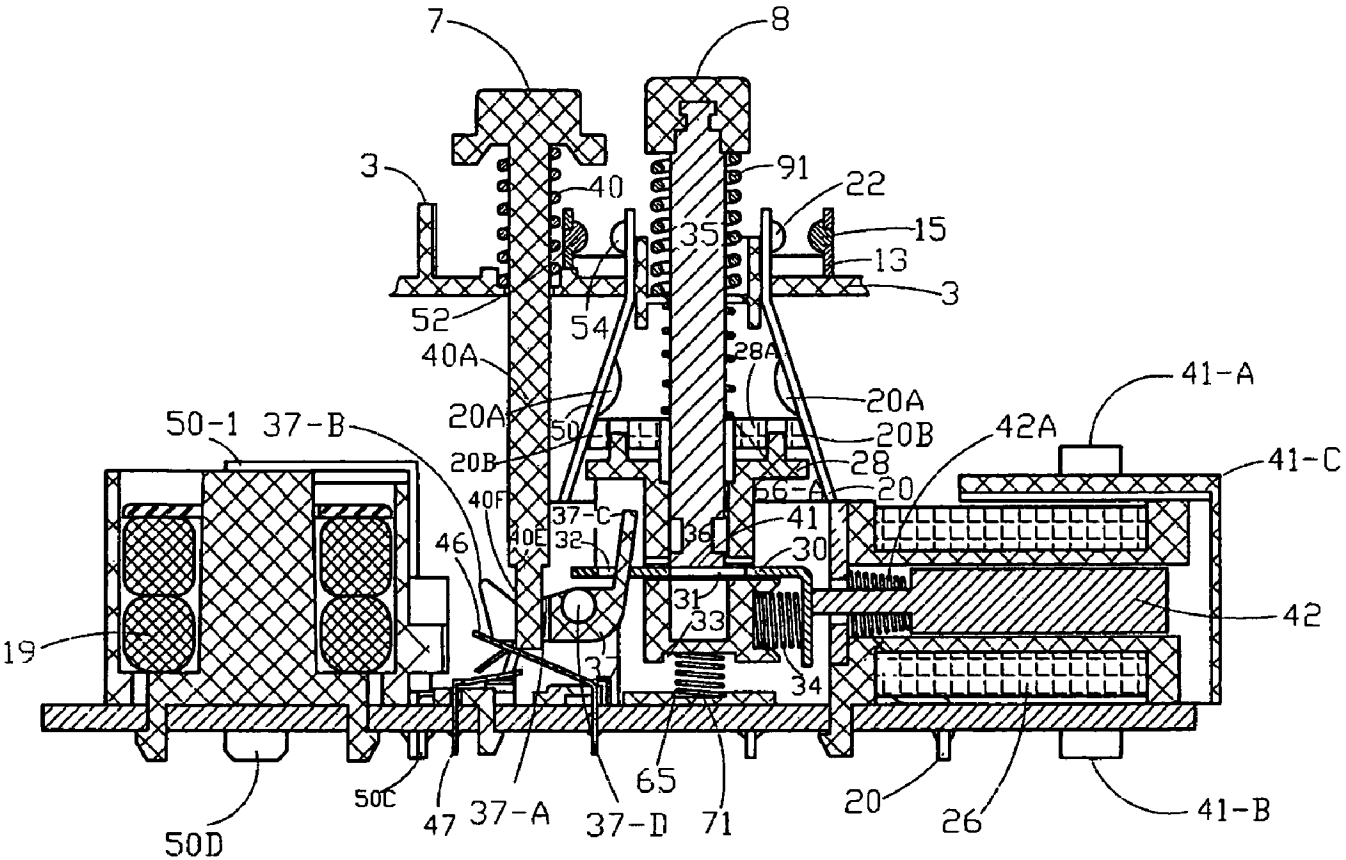
Figures 3, 7:
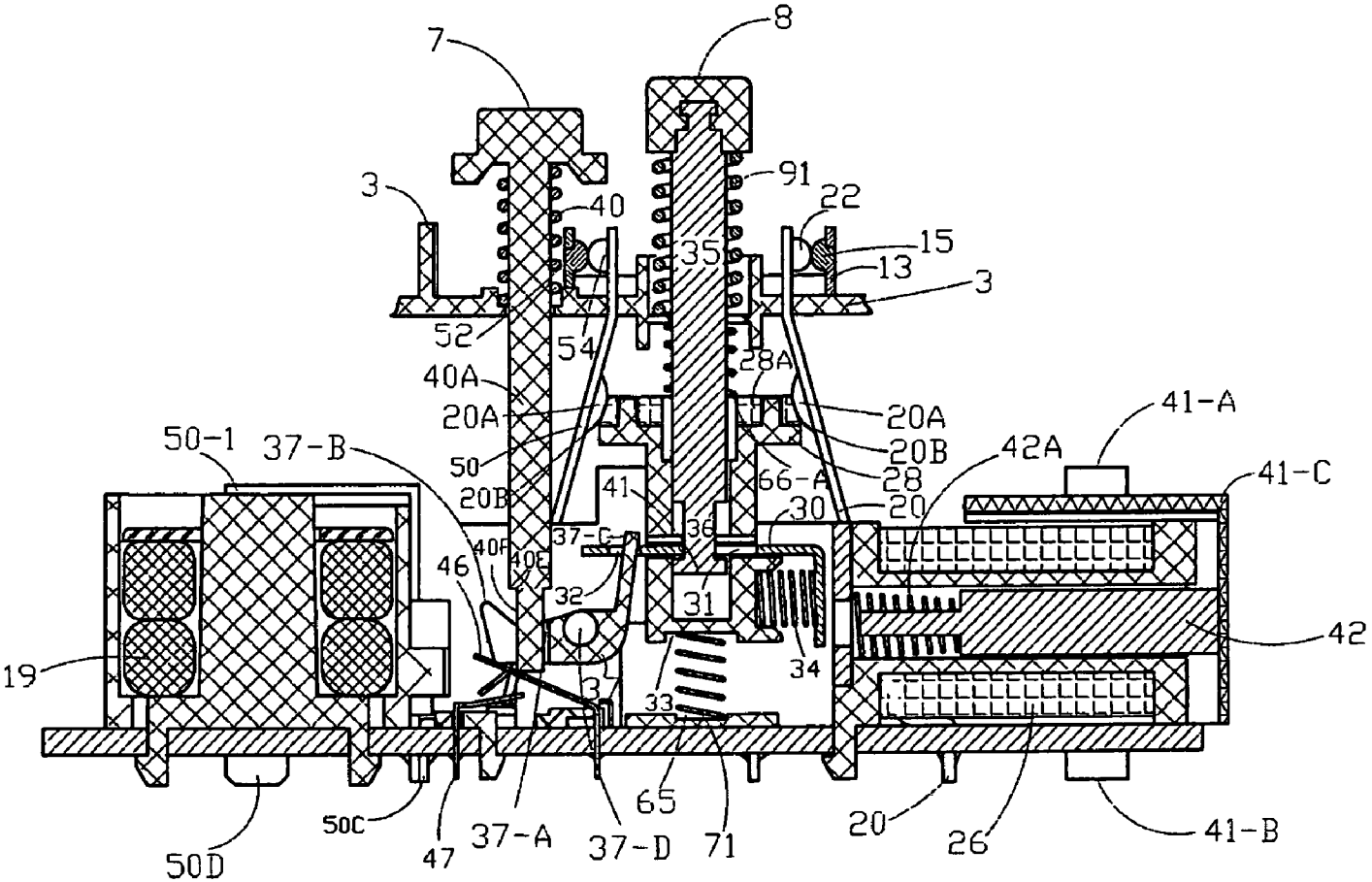
Figures 1, 9:
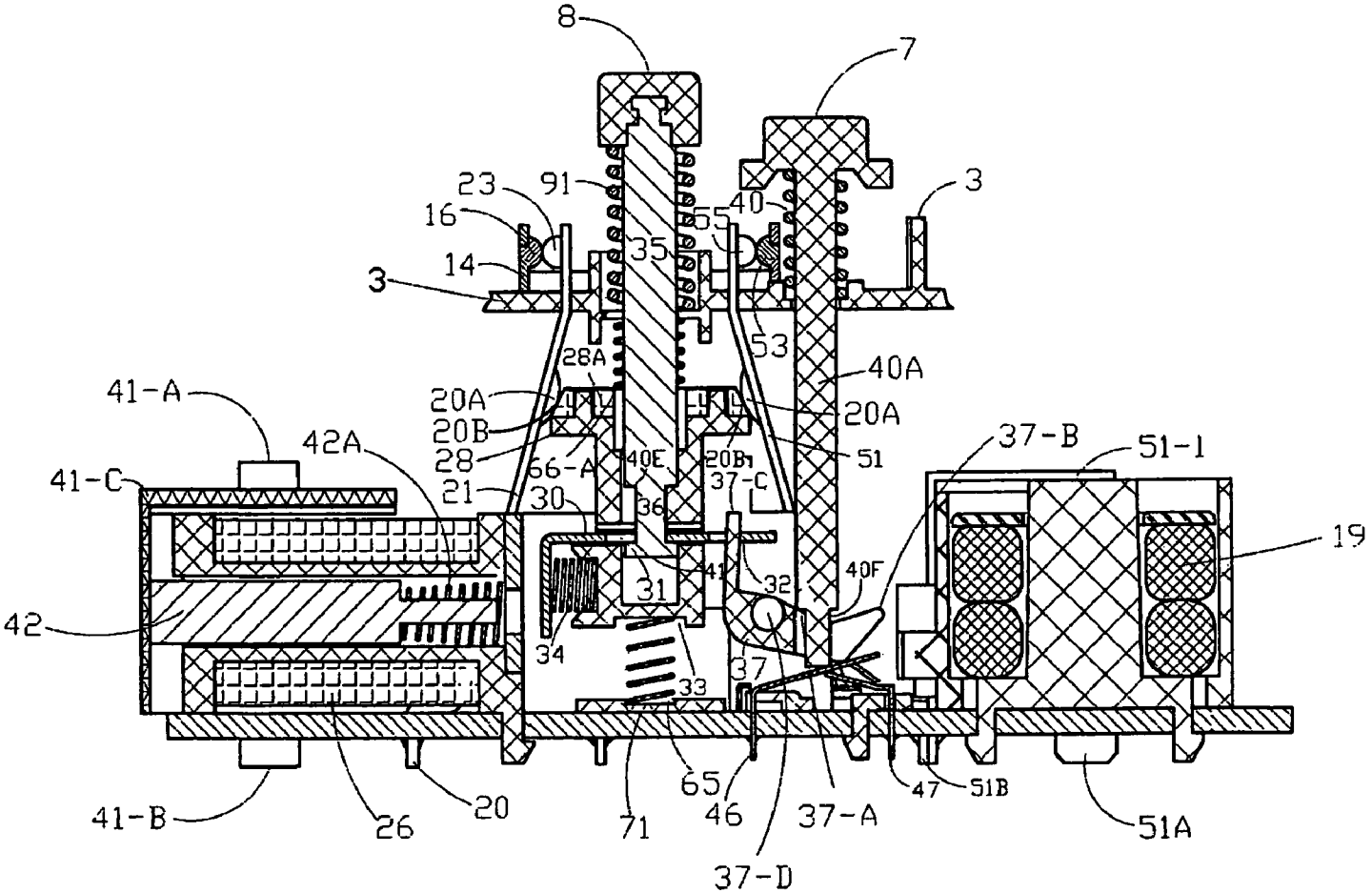
Figures 2, 9:
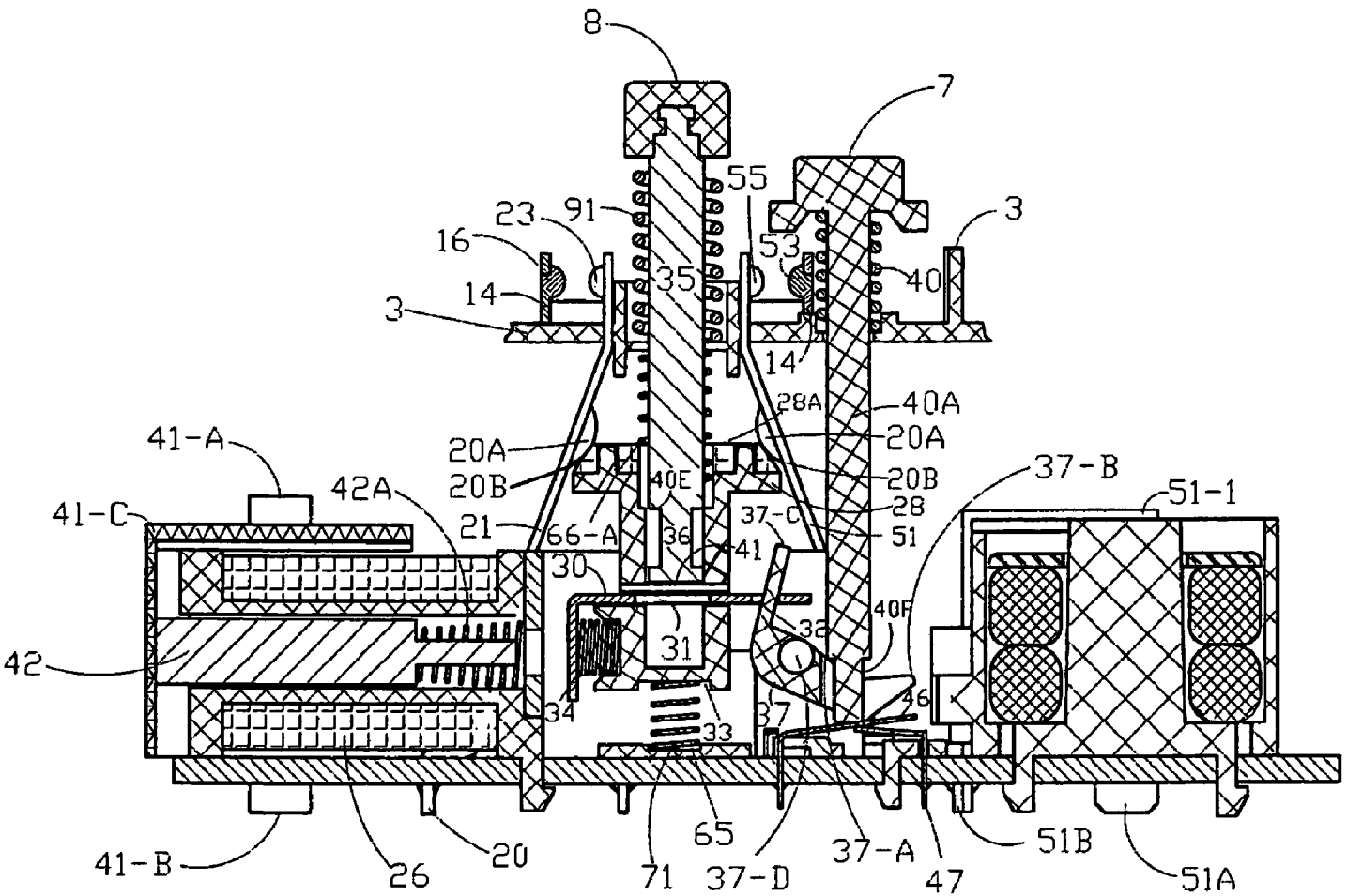

As shown in FIGS. 1, 4, and 5, two obliquely placed flexible connecting output metal pieces 20 and 21 are also placed on circuit board 18. As shown in FIGS. 1 and 7-1, one end of obliquely placed flexible connecting output metal piece 20 comes into contact with neutral power line output end 80. Together, they are welded onto the circuit board 18 and are connected to neutral power line output wiring screw 109. The other end of piece 20 is inclined upward, and moving contact 22 is placed in the end section of the upwardly inclined end of piece 20. The moving contact 22 corresponds to fixed contact 15 on neutral power output conductor 13 (as shown in FIGS. 3 and 4), with which it forms a power switch. Similarly, as shown in FIGS. 1 and 9-1, one end of obliquely placed flexible connecting output metal piece 21 comes into contact with hot power line output end 81. Together, they are welded onto circuit board 18 and are connected to hot power line output wiring screw 110. The other end of piece 21 is inclined upward, and moving contact 23 is placed in the end section of the upwardly inclined end of piece 21. The moving contact 23 corresponds to fixed contact 16 on hot power line output conductor 14 (as shown in FIGS. 3 and 4), with which it forms a power switch.

As shown in FIGS. 3 and 4, moving and fixed contacts on the flexible power input metal pieces 50 and 51, power output conductors 13 and 14, and flexible connecting output metal pieces 20 and 21 form a total of two groups, and four pairs, of neutral line and hot line power switches: 54 and 52, 22 and 15, 55 and 53, and 23 and 16. These switches correspond, respectively, to switches KR-2-2, KR-3-2, KR-2-1 and KR-3-1 in the wiring diagrams shown in FIGS. 11 and 12.

Figure 11:
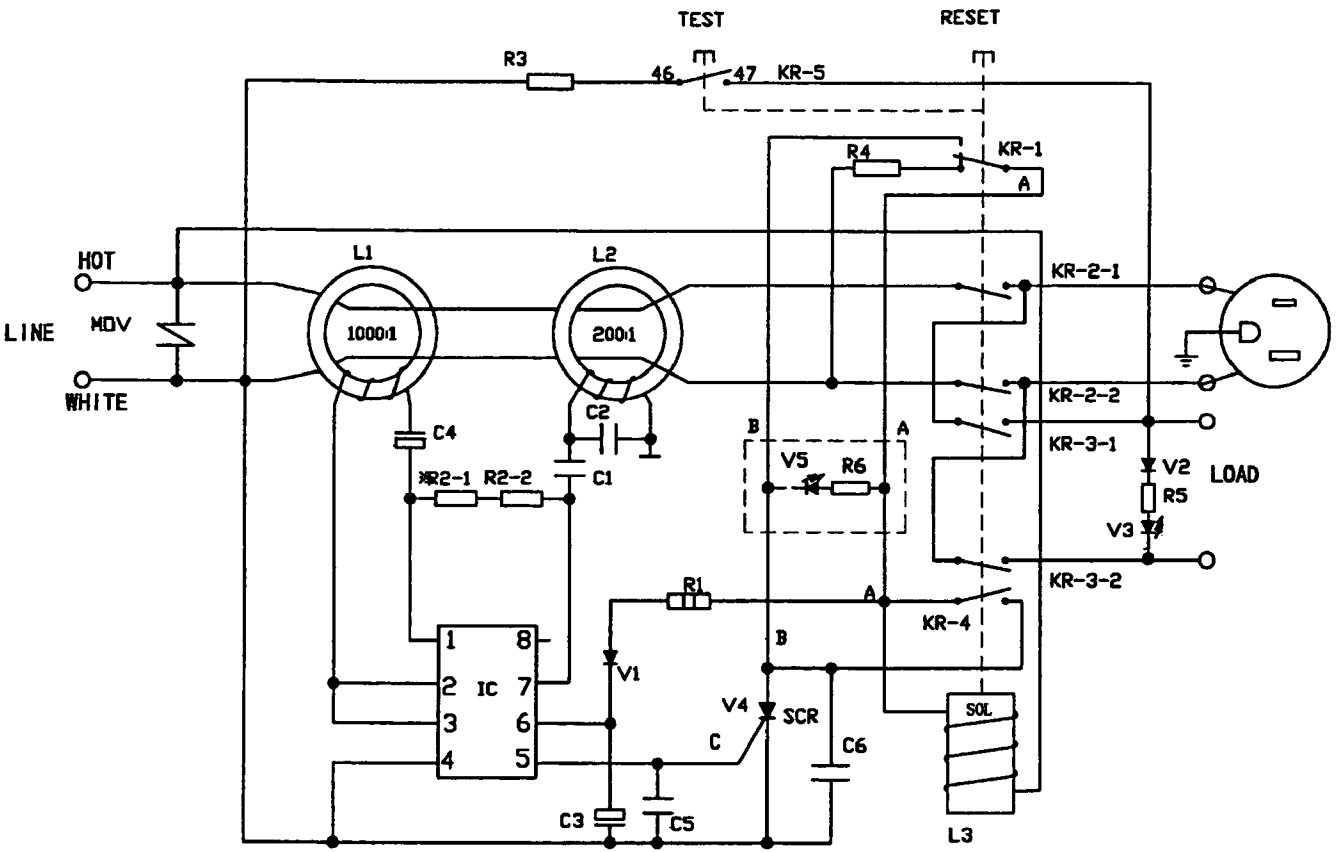
FIG. 11 is a wiring diagram of a control circuit of the GFCI device of FIG. 1.
Figure 12:
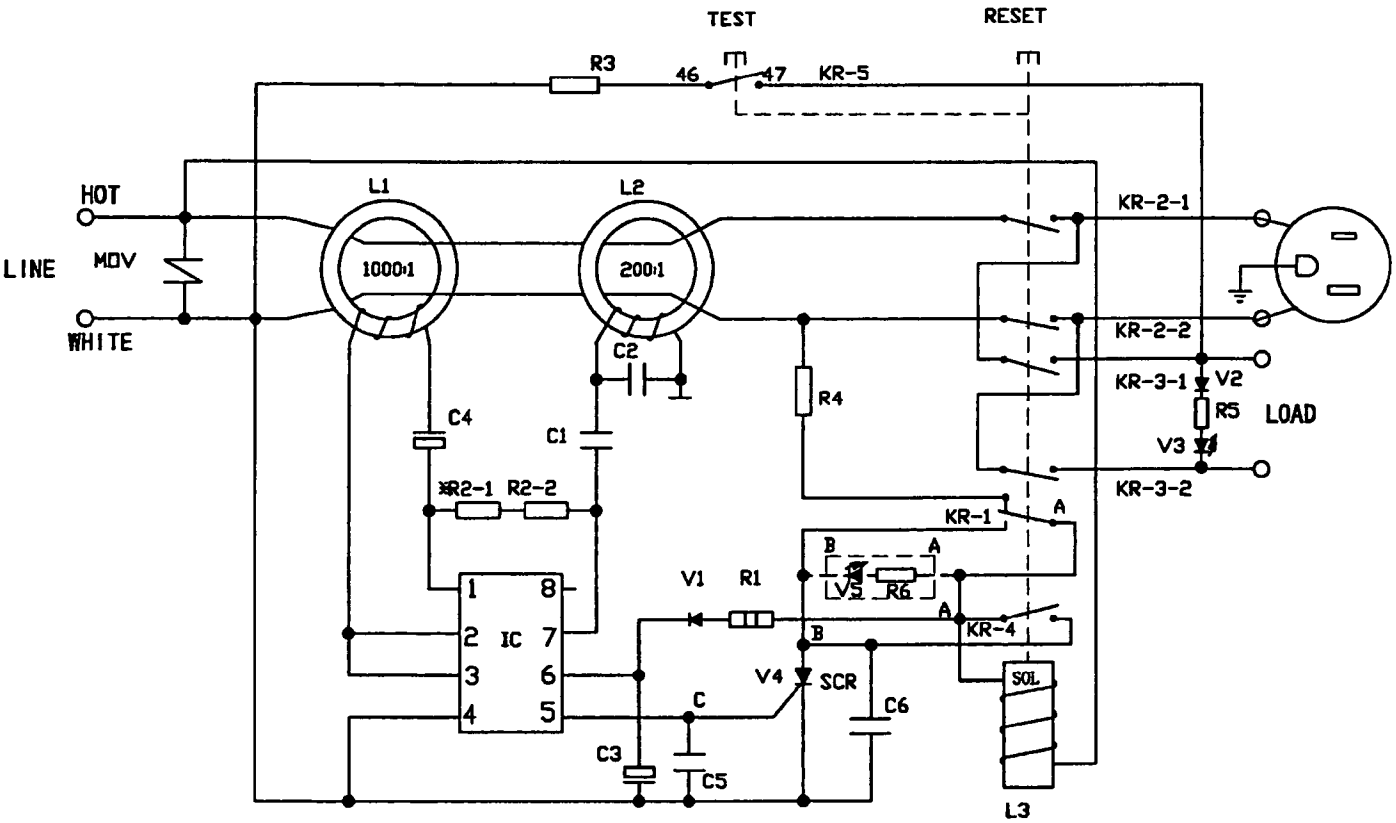
FIG. 12 is another wiring diagram of a control circuit of the GFCI device of FIG. 1.

As shown in FIGS. 1, 5 and 7-1, differential transformer 19 on circuit board 18 is used for detecting leakage current. As shown in FIG. 11 and FIG. 12, the hot power line HOT and neutral line WHITE thread through differential transformer 19 (L1 and L2 in FIGS. 11 and 12). When a leakage current exists on the power supply loop, the differential transformer 19 outputs a voltage signal to the leakage current detection control chip IC (such as model No. RV4145, for example). Pin 5 of the control chip IC outputs a control signal to silicon controlled rectifier (SCR), causing a reset/tripping mechanical device on circuit board 18 to act, thereby releasing the reset button 8 and tripping the GFCI device, which cuts off the power output of the GFCI device.

As shown in FIGS. 1, 5, 6, 7-1 and 10-1, a reset/tripping mechanical device, placed on circuit board 18, causes flexible power input metal pieces 50 and 51 to be electrically connected to or disconnected from power output conductors 13 and 14. This device also causes flexible connecting output metal pieces 20 and 21 to energize or de-energize through power output conductors 13 and 14, which in turn causes power output ends 80 and 81 to energize or de-energize. The reset/tripping mechanical device includes an "I" shaped plastic reset support piece 28A, a "T" shaped tripping device 28 coupled to reset button 8, locking member 30, locking member spring 34, reset directional lock 35, reset spring 91, quick tripping spring 66-A, simulated leakage current generation switches 66, 67, and 88, reset switches 72 and 72A and reset lift spring 71 coupled to the reset button 8, flexible metal switch pieces 46 and 47 coupled to the test button 7, sliding block 37, and solenoid coil 26.

The "I" shaped plastic reset support piece 28A is located directly below reset button 8 and directly above the "T" shaped tripping device 28. The upper surface area of the two larger ends of the "I" shaped reset support piece 28A is smaller than the lower surface area, with oblique planes 20B forming the sides of the "I" shaped reset support piece 28A. As shown in FIG. 7-1, the end of flexible neutral power line input metal piece 50 that is inclined upward and the end of flexible connecting output metal piece 20 that is inclined upward lean against oblique planes 20B on the two sides of one end of the "I" shaped reset support piece 28A in a "herringbone" fashion. A semicircular protruding point 20A is placed in the upper part of the side of oblique plane 20B on neutral power line input metal piece 50 where piece 50 comes into contact with the oblique plane 20B on one side of the "I" shaped reset support piece 28A. Another semicircular protruding point 20A is placed in the upper part of the side of oblique plane 20B on flexible connecting output metal piece 20 where piece 20 comes into contact with oblique plane 20B on the other side of the "I" shaped reset support piece 28A.

As shown in FIG. 9-1, one end of flexible hot power line input metal piece 51 that is inclined upward and one end of flexible connecting output metal piece 21 that is inclined upward lean against oblique planes 20B on the two sides of the other end of the "I" shaped reset support piece 28A in a "herringbone" fashion. A semicircular protruding point 20A is placed in the upper part of the side of oblique plane 20B on hot power line input metal piece 51 where piece 51 comes into contact with oblique plane 20B on one side of the "I" shaped reset support piece 28A. Another semicircular protruding point 20A is placed in the upper part of the side of oblique plane 20B on flexible connecting output metal piece 21 where metal piece 21 comes into contact with oblique plane 20B on the other side of the "I" shaped reset support piece 28A.

Figure 6:
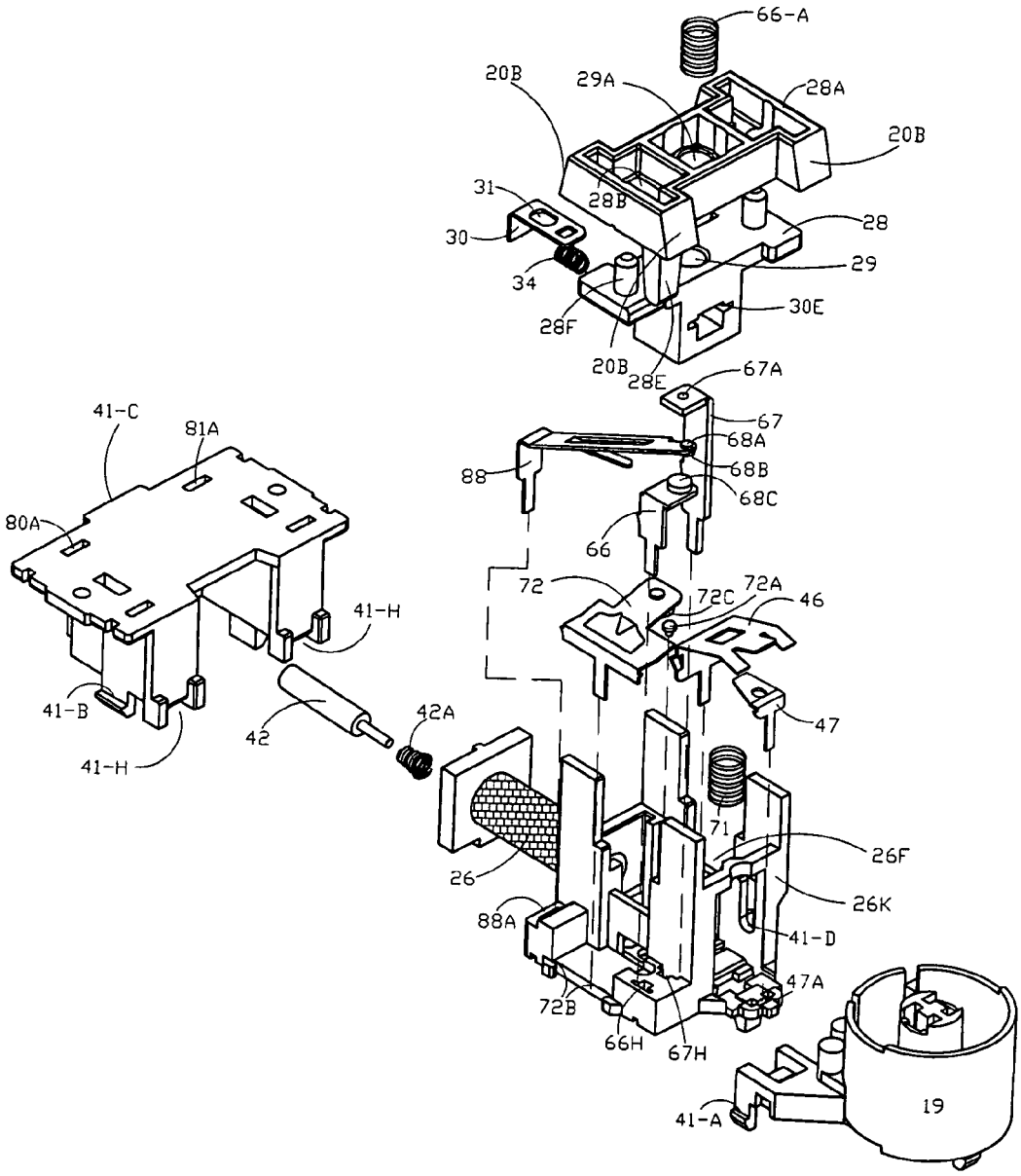
FIG. 6 is an exploded cubic schematic of the structure of an embodiment of a reset/tripping mechanical device of the GFCI device of FIG. 1.

As can be seen in FIGS. 6 and 9-1, through holes 28B are placed on the left and right ends of the "I" shaped reset support piece 28A. A straight through hole 29A is placed in the middle of the "I" shaped reset support piece 28A allowing reset directional lock 35 to thread through the "I" shaped reset support piece 28A. A quick tripping spring 66-A is placed above the straight through hole 29A. When the reset button 8 is in a released state, pushed up by quick tripping spring 66-A, the "I" shaped reset support piece 28A is placed on the placement spacer in a fixed position set aside for it on coil framework 26K.

The "T" shaped tripping device 28 is located directly below the "I" shaped reset support piece 28A and is coupled to reset button 8. The "T" shaped tripping device 28 extends outward on the left and right sides to form two lifting arms. Round platform shaped protrusions 28F are placed on the left and right lifting arms. The round platform shaped protrusions 28F can move up and down inside through holes 28B on reset support piece 28A, causing reset support piece 28A to be in contact with tripping device 28 or to be separated from the tripping device 28.

A central through hole 29 penetrates device 28 top to bottom in line with through hole 29A. A reset spring 91 is slid onto the reset directional lock 35 and contacts the bottom surface of the reset button 8. The reset directional lock 35 can move up and down through holes 29A and 29 through the "I" shaped reset support piece 28A and tripping device 28, respectively. Reset spring 91 also passes through a round center hole on the middle support 3, through which the reset directional lock 35 moves. Quick tripping spring 66-A is pressed down in the lower part of the middle support 3 and directly below the center hole.

A circle of recessed lock slots 36 are formed in the lower part of reset directional lock 35 near its bottom. Bottom surface 41 of reset directional lock 35 is forms a plane. As shown in FIG. 6, a through hole 30E is opened in the middle section of tripping device 28. A movable "L" shaped locking member 30, having a downwardly projecting section, and preferably made of metal materials, is located in through hole 30E. A locking member hole 31 is formed on the top surface of locking member 30. The bottom surface 41 of reset directional lock 35 is in a staggered state with locking member hole 31 on the top surface of locking member 30.

A locking member spring 34 is placed between the inside walls of tripping device 28 and the downwardly projecting section of locking member 30. A solenoid coil 26 with an iron core 42 is placed in proximity to the locking member 30. Iron core 42 directly faces the downwardly projecting section of locking member 30. Under the action of iron core 42, locking member 30 can move horizontally, thus enabling the reset directional lock 35 to thread in or out of the hole 31 of locking member 30. Reset button 8 occupies one of two positions: reset or released (tripped). Tower shaped spring 42A is slid onto the end section iron core 42.

Tripping device 28 is accommodated in accommodation slot 26F of the coil framework 26K. A reset lift spring 71 is placed between the bottom of tripping device 28 and the bottom of slot 26F.

Figures 1, 10:
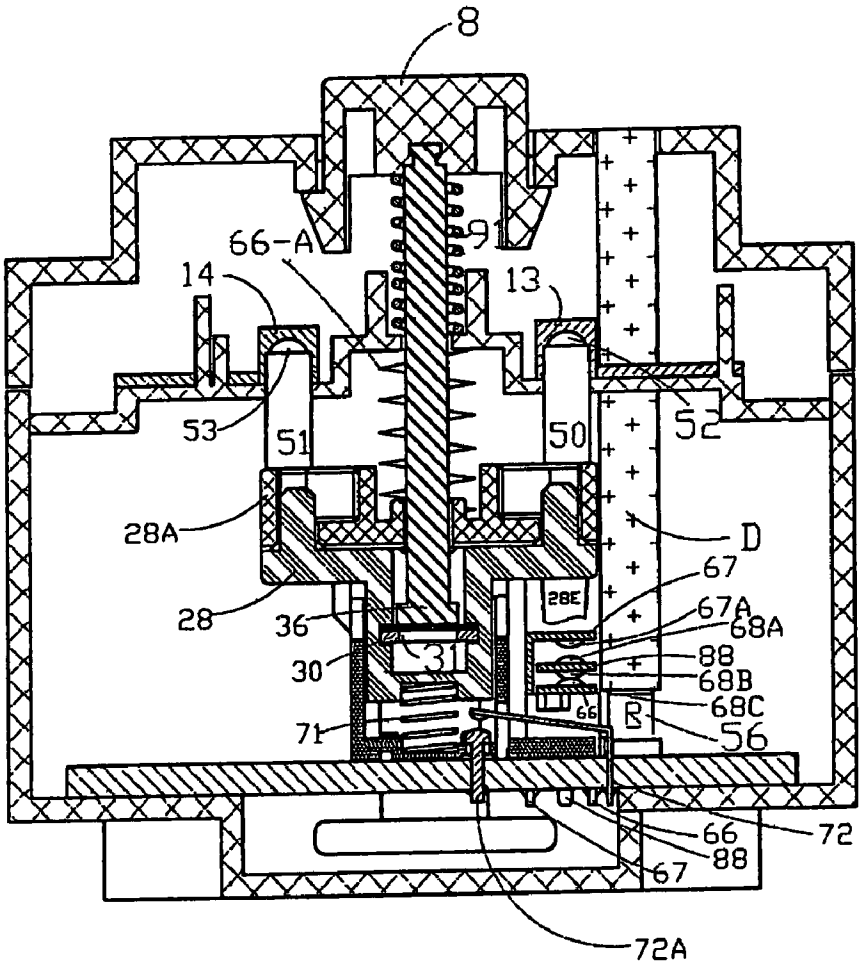
Figures 2, 10:
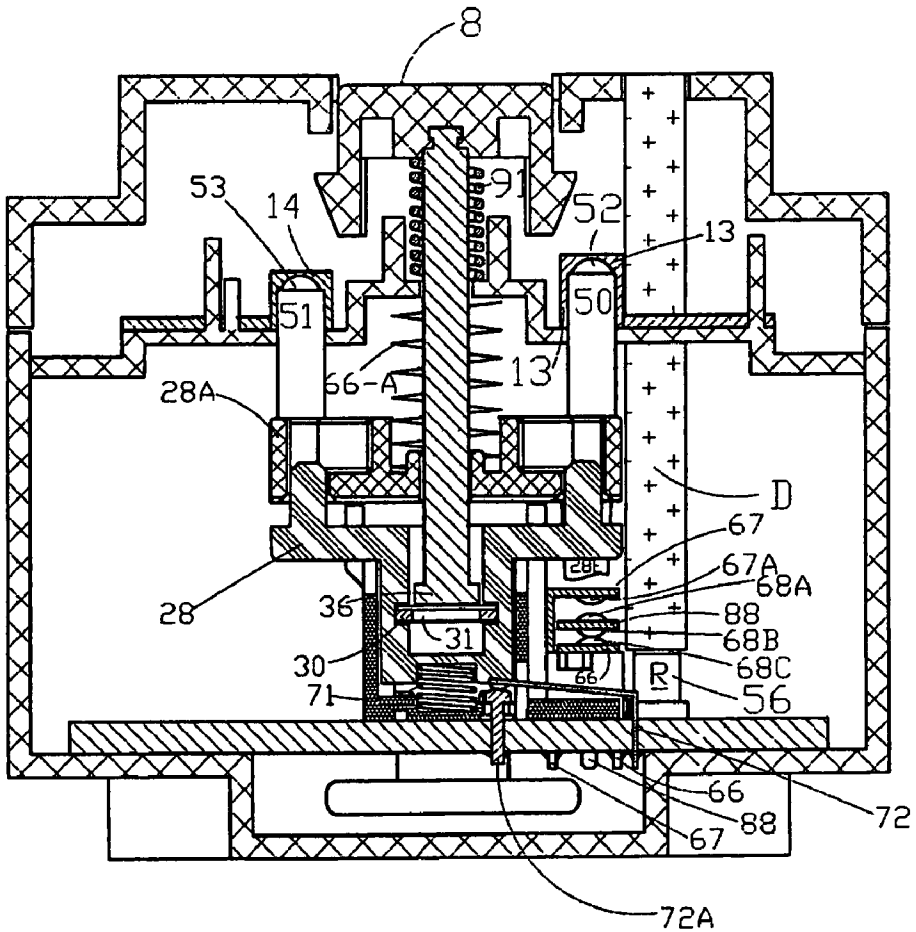
Figures 3, 10:
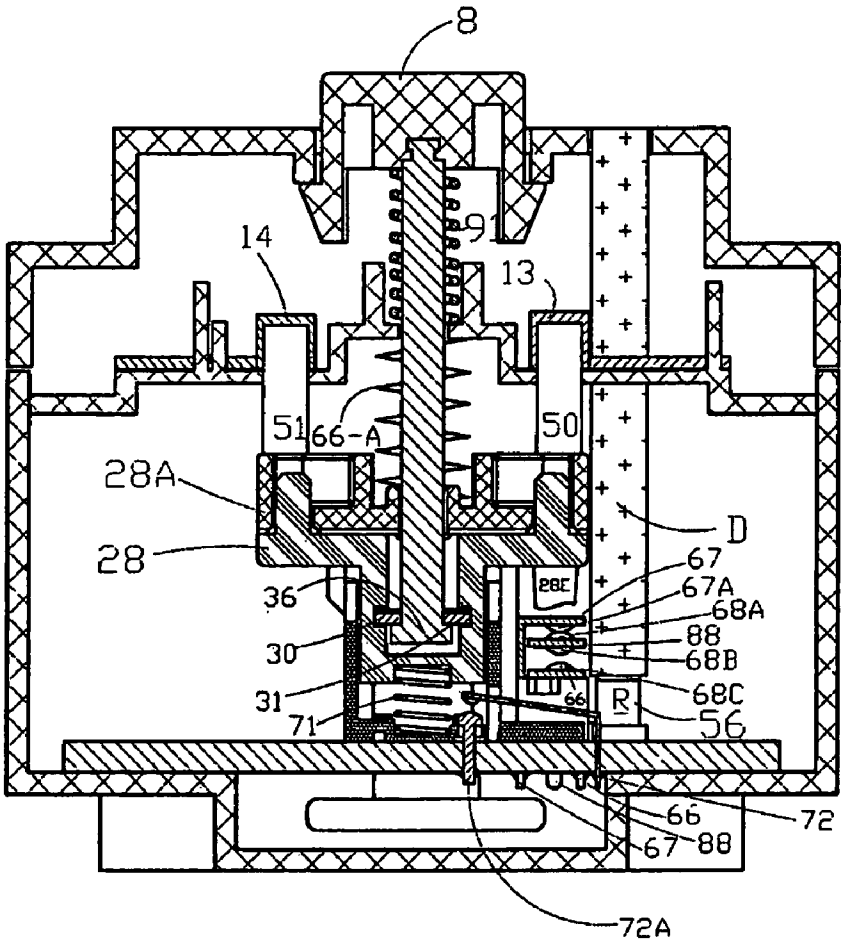

As shown in FIGS. 6 and 10-1, a simulated leakage current generation switch (switch KR-1 in FIGS. 11 and 12) coupled to reset button (RESET) 8 is placed next to tripping device 28. The simulated leakage current generation switch includes three triangularly arranged flexible metal pieces 66, 67 and 88. A contact 68C, formed through punching, is placed on the upper surface of metal piece 66. Contacts 68A and 68B are respectively placed on the upper and lower surfaces of flexible metal piece 88. A contact 67A is placed on the lower surface of metal piece 67. A contact pin 28E extends downward from one corner of the "I" shaped reset support piece 28A. When the interrupter is not reset, pushed and pressed by quick tripping spring 66-A, reset support piece 28A stays in the placement spacer in a fixed position on the coil framework set aside for it, causing contact pin 28E just to press down on the flexible metal piece 88.

As shown in FIGS. 10-1 and 10-2, when reset button 8 is in its released state, that is, when the reset button 8 is not reset, since reset support piece 28A is blocked by the placement spacer in a fixed position on the coil framework 26K, the reset support piece 28A stays in the placement spacer. Contact pin 28E extending downward from the "I" shaped reset support piece 28A causes contact 68B on the lower surface of flexible metal piece 88 to stay in contact with contact 68C and become conducting. When the reset button 8 goes from the released state to a reset state, as shown in FIG. 10-3, tripping device 28 moves up, driving the "I" shaped reset support piece 28A to move up and causing contact pin 28E to concurrently move away from the upper surface of flexible metal piece 88. Under its own flexible action, flexible metal piece 88 causes contact 68B on its lower surface to disconnect from contact 68C on the upper surface of metal piece 66. Contact 68A on the upper surface of flexible metal piece 88 comes into contact with contact 67A on the lower surface of metal piece 67 and become conducting.

As shown in FIGS. 11 and 12, metal piece 66 is connected to the neutral input line through simulated leakage current limiting resistor R4. Metal piece 88 in its middle is connected to the input hot line through solenoid coil SOL 26. Metal piece 67 is connected to the neutral line on the power input end through the SCR V4 on the leakage current detection circuit. Therefore, after the power input end of the GFCI device is properly connected to the power source, the hot line, the solenoid coil SOL 26, metal piece 88, metal piece 66, resistor R4, the neutral line that threads through differential transformers L1 and L2 form a simulated leakage current generating loop that, without the need to operate any part of the GFCI device, can automatically generate a simulated leakage current to detect whether the GFCI device has come to the end of its life. If the GFCI device has not come to the end of its life, reset indicator V5 is lit. If the GFCI device has come to the end of its life, the reset button 8 cannot be reset and reset indicator V5 is not lit. After reset button 8 is reset, metal piece 88 is disconnected from metal piece 66, comes into contact with metal piece 67, and becomes conducting, thereby removing the simulated leakage current.

As shown in FIGS. 6 and 10-1, a reset switch (KR-4 in FIGS. 11 and 12) is coupled to reset button 8 and is placed below tripping device 28. The reset switch includes flexible metal piece 72 and contact 72A. The reset switch is serially connected into the leakage current detection circuit. When reset button 8 is in a released state, flexible metal piece 72 and contact 72A are not in contact and the reset switch is open. When reset button 8 is pressed down, tripping device 28 and reset lift spring 71 are pressed down, causing tripping device 28 to be pressed onto flexible metal piece 72. When pressed down, flexible metal piece 72 comes into contact with contact 72A and becomes conducting. In this condition, the reset switch is closed. When reset button 8 is released, under the elastic action of reset lift spring 71, tripping device 28 is lifted off flexible metal piece 72, causing flexible metal piece 72 to disconnect from contact 72A and the reset switch is open.

As shown in FIG. 7-1, the test button 7 sits atop arm 40A onto which spring 40 is slid. At a position close to its lower end, arm 40A shrinks inward to form step 40E and a small cylindrical body 40F that continues to extend downward. A "spoon" shaped sliding block 37 is placed at the lower part of step 40E. A through slot with a width smaller than step 40E but greater than the diameter of small cylindrical body 40F is placed vertically on sliding block 37 (in the area between parts numbers 37-A and 37-B in FIG. 1). Sliding block 37 is fixed inside vertical guide slots 41-D (see FIG. 6) on two sides on the front end of solenoid coil framework 26K. The projections 37-D act as rotating axles (see FIG. 6) and allow the sliding block 37 to rotate. Step 40E is pressed on two sides of the aforementioned through slot to cause rotation of sliding block 37.

As shown in FIG. 7-1, handle 37-C of sliding block 37 is inclined upward and threads through hole 32 on the top of locking member 30 near one end of the test button 7. Below side 37-B opposite handle 37-C, a pair of flexible metal switch pieces 46 and 47 (see FIG. 6), form test switch KR-5 (as shown in FIGS. 11 and 12) that is used to manually generate a simulated leakage current. Small cylindrical body 40F at the bottom of arm 40A, pushes against flexible metal piece 46. As shown in FIG. 6, one end of flexible metal piece 46 bends downward to thread through a hole opened oil solenoid coil framework 26K and is welded onto the circuit board 18. Through resistor R3, test switch KR-5 is connected to the neutral power line. The other end of flexible metal piece 46 is unsupported. One end of flexible metal switch piece 47 is unsupported. The other end also threads through a hole opened on the solenoid coil framework 26K and is welded onto the circuit board 18, and connects to the power output hot line. The unsupported end of flexible metal piece 46 is located directly above the unsupported end of flexible metal switch piece 47, and normally the two unsupported ends are not in contact. As shown in FIGS. 7-1 through 7-3 and FIG. 8-1, when test button 7 is not pressed down, the upper ends of the flexible metal switch pieces 46 and 47 don't contact, and test switch KR-5 (FIGS. 11 and 12) is disconnected. As shown in FIGS. 8-2 through 8-3 and FIGS. 9-1 and 9-2, when test button 7 is pressed down, the upper ends of flexible metal switch pieces 46 and 47 come into contact, and test switch KR-5 is closed, thereby manually generating a simulated leakage current.

As shown in FIG. 6, tripping device 28, simulated leakage current generation switch (pieces 66, 67 and 88), reset switch (pieces 72 and 72A) coupled to the reset button 8, test switch (flexible metal switch pieces 46 and 47) coupled to the test button 7, and sliding block 37 all are placed inside solenoid coil framework 26K. A solenoid coil protection cover 41-C is placed over coil of solenoid coil 26. Four rectangular holes 80A and 81A are placed on the top of cover 41-C. Hook pins 41-B are placed on the left and right sides of cover 41-C, and are used to hook the cover 41-C into holes on circuit board 18. Slots 41-H are respectively on the left and right of the front side of the cover 41-C and are used to secure flexible connecting output metal pieces 20 and 21. As shown in FIG. 1, protruding points 80F and 81F are respectively placed on the top of power output ends 80 and 81, which in turn fit, respectively, into holes 80A and 81A on top of solenoid coil protection cover 41-C.

Reset support piece 28A, tripping device 28, locking member 30, locking member spring 34 and sliding block 37, the simulated leakage current generation switch, the reset switch, reset directional lock 35, reset spring 91, quick release spring 66-A, reset lift spring 71 and solenoid coil 26 are interconnected to form a freely movable assembly.

FIGS. 11 and 12 are wiring diagrams for the control circuit of the GFCI device. As shown in the wiring diagrams, the control circuit includes differential transformers L1 (1000:1) and L2 (200:1), which are used for detecting an electric leakage current, control chip IC (e.g., RV4145), solenoid coil 26 (SOL), with a built in iron core, silicon controlled rectifier SCR V4, simulated leakage current generation switch KR-1 and reset switch KR-4, both of which are coupled to the reset button RESET, switches KR-2-1, KR-2-2, KR-3-1 and KR-3-2, which are serially connected in the power supply line, switch KR-5, which is coupled to the test button TEST, reset indicator V5, power output indicator V3, and related diodes, resistor and capacitors.

After the hot line HOT and neutral line WHITE on the power supply line thread through differential transformers L1 and L2, the leakage current detection signal output ends of differential transformers L1 and L2 are connected to signal input ends 1, 2, 3 and 7 of the control chip IC. Control signal output end 5 of the control chip IC is connected to the gate of SCR V4. The negative pole of SCR V4 is connected to the neutral line (WHITE) of the power input end. The positive pole of SCR V4 is connected to the hot line (HOT) through metal piece 67 of simulated leakage current generation switch KR-1 which is coupled to the reset button RESET, and solenoid coil SOL. The iron core of solenoid coil SOL causes the reset button RESET to reset or to release through the mechanical tripping device, thus causing switches KR-2-1, KR-2-2, KR-3-1 and KR-3-2 to close or open.

A power output indicator V3 is connected between hot power line HOT and neutral line WHITE output ends (ends 81 and 80—see FIG. 1). Reset indicator V5 is connected in the conduction loop of SCR V4.

Power input end hot line HOT is connected to power input end neutral line WHITE that thread through differential transformers L1 (1000:1) and L2 (200:1) through solenoid coil 26 (SOL), metal piece 66 and 88 in simulated leakage current generation switch KR-1 and simulated leakage current limiting resistor R4, forming a simulated leakage current generation circuit. This circuit makes it possible to automatically generate a simulated leakage current after the power input ends of the ground fault circuit interrupter are properly connected to the power lines without the need to operate any part of the GFCI device.

As shown in FIGS. 11 and 12, after the power input ends of the GFCI device are properly connected to the power lines and with the reset button RESET not reset and simulated leakage current generation switch KR-1 closed (i.e., metal piece 66 and metal piece 88 have come into contact and become conducting), a simulated leakage current can be automatically generated without the need to operate any part of the GFCI device. The simulated leakage current sensed by leakage current differential transformers L1 and L2. A high potential control signal is output from pin 5 of the IC to the gate of SCR V4, and SCR V4 is triggered. The positive pole and the negative pole of the SCR V4 become conducting. Reset indicator V5, which is connected between nodes A and B, is lit, indicating that the functions of the GFCI device are intact and that the GFCI device can provide protection against a leakage current. The reset button RESET then can be reset. By contrast, if the GFCI device has come to the end of its life, then SCR V4 does not conduct and reset indicator V5 is not lit. No current flows through solenoid coil 26, and the internal iron core 42 does not act. As a result, the mechanical release device (locking member 30) will not act and the reset button RESET cannot be reset, thus prompting the user that the GFCI device has come to the end of its life and should be replaced with a new ground fault circuit interrupter.

Referring to FIGS. 11, 12, and 7-2, the reset button RESET has been pressed, simulated leakage current generation switch KR-1 has not been opened, but reset switch KR-4 has been closed. Closing reset switch KR-4 causes a short connection between nodes A and B, and the original voltages on both ends of AB are added to solenoid coil (SOL) 26, thus causing current to flow through solenoid coil SOL, generating a magnetic field and causing the iron core 42 to move. As shown in FIG. 7-3, locking member 30 then opens and directional lock 35 threads through locking member hole 31 on locking member 30. At the same time, light emitting diode V5 connected between points A and B moves to an off state and light V5 goes out. Switch KR-1 opens (i.e., metal piece 66 and metal piece 88 move apart) and the simulated leakage current stops flowing. After this reset operation, switches KR2-1, KR2-2, KR3-1 and KR3-2 are closed, so that power output indicator V3, which is parallelly connected between the GFCI device load output end hot power line and neutral line, is lit, indicating that both the single phase, three line socket on the surface of the GFCI device and LOAD output end have power output.

If the GFCI device has come to the end of its life, normal electric current does not flow through inside solenoid coil (SOL) 26, and its iron core will not act and will not move locking member 30 and the reset button will never be able to reset. Neither the single phase, three line socket on the surface of the GFCI device nor the load output end will have power output and reset indicator V5 and power output indicator V3 will not be lit.

When functions of the GFCI device are intact, after the GFCI device is properly connected to a power source, and after the reset button RESET is pressed, the LOAD end and the surface of the GFCI device have power outputs. The GFCI device works normally, as shown in FIG. 7-3. At this time, when a leakage current is generated inside the GFCI device, due to the fact that hot line HOT and neutral line WHITE both thread through the leakage current differential transformers L1 and L2 concurrently, the vector sum of the current in the lines that thread through the differential transformers L1 and L2 is not zero. The differential transformers immediately sense a voltage signal and provide a signal input into the control chip IC. A release control signal is output from pin 5 of the control chip IC to the gate of SCR V4. SCR V4 is triggered and the positive pole and the negative pole conduct, causing node B on the positive pole of SCR V4 to be at a low electric potential. At this time, switch KR-4 is in a closed state, and nodes A and B are the same potential. Because the other end of coil SOL 26 is connected to the hot power line, both ends of coil SOL 26 will receive a voltage. Electric current flows through coil SOL 26 and generates a magnetic field. The iron core 42 is engaged, causing the mechanical tripping device of the GFCI device to act (locking member 30 moves), which causes the reset directional lock 35 of reset button 8 to thread out from locking member hole 31 of locking member 30. Reset button 8 is released, cutting off power output from the GFCI device. As shown in FIG. 7-1, power output indicator V3 goes out and reset indicator V5 is lit.

Figures 1, 8:
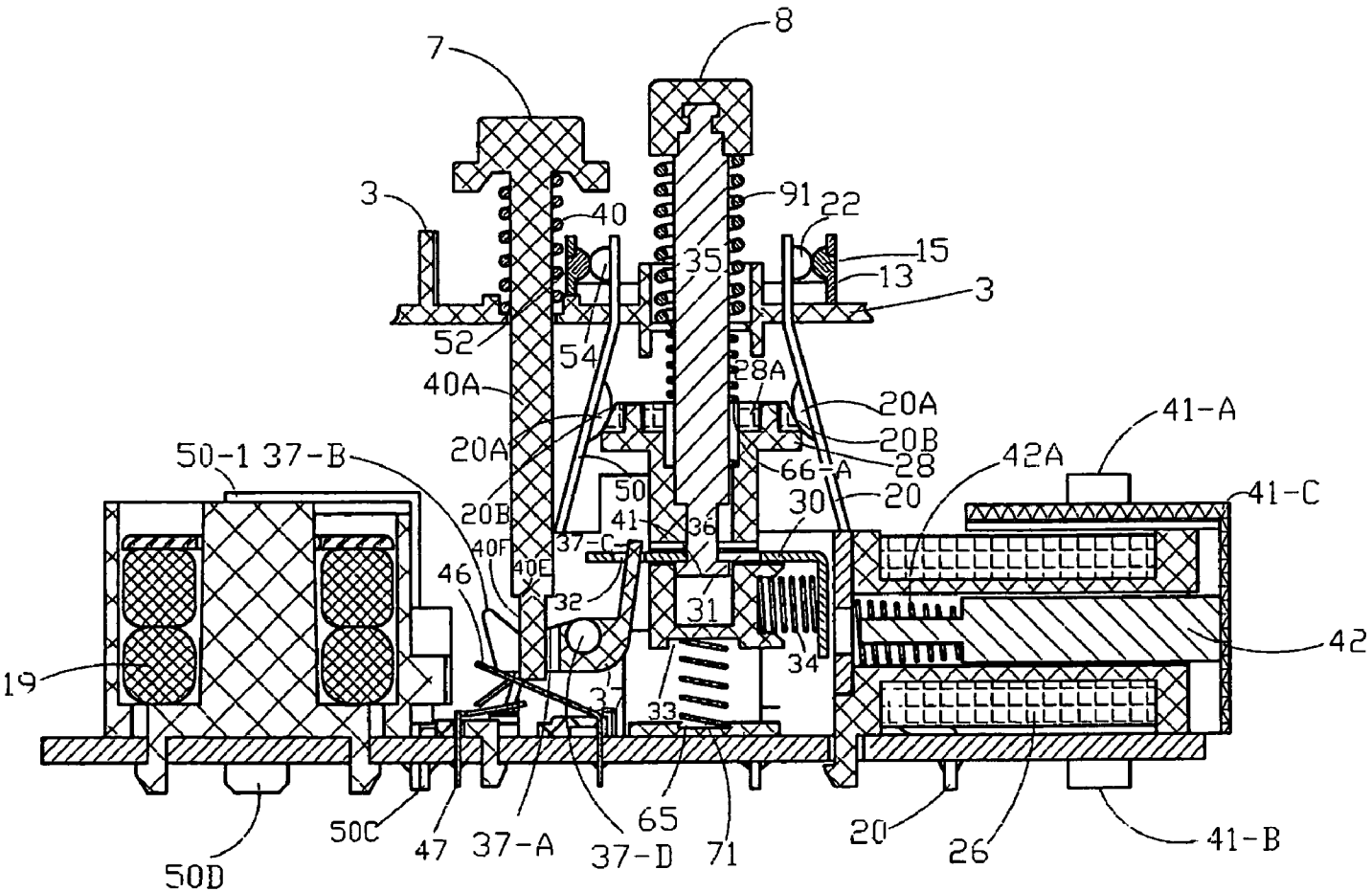
Figures 2, 8:
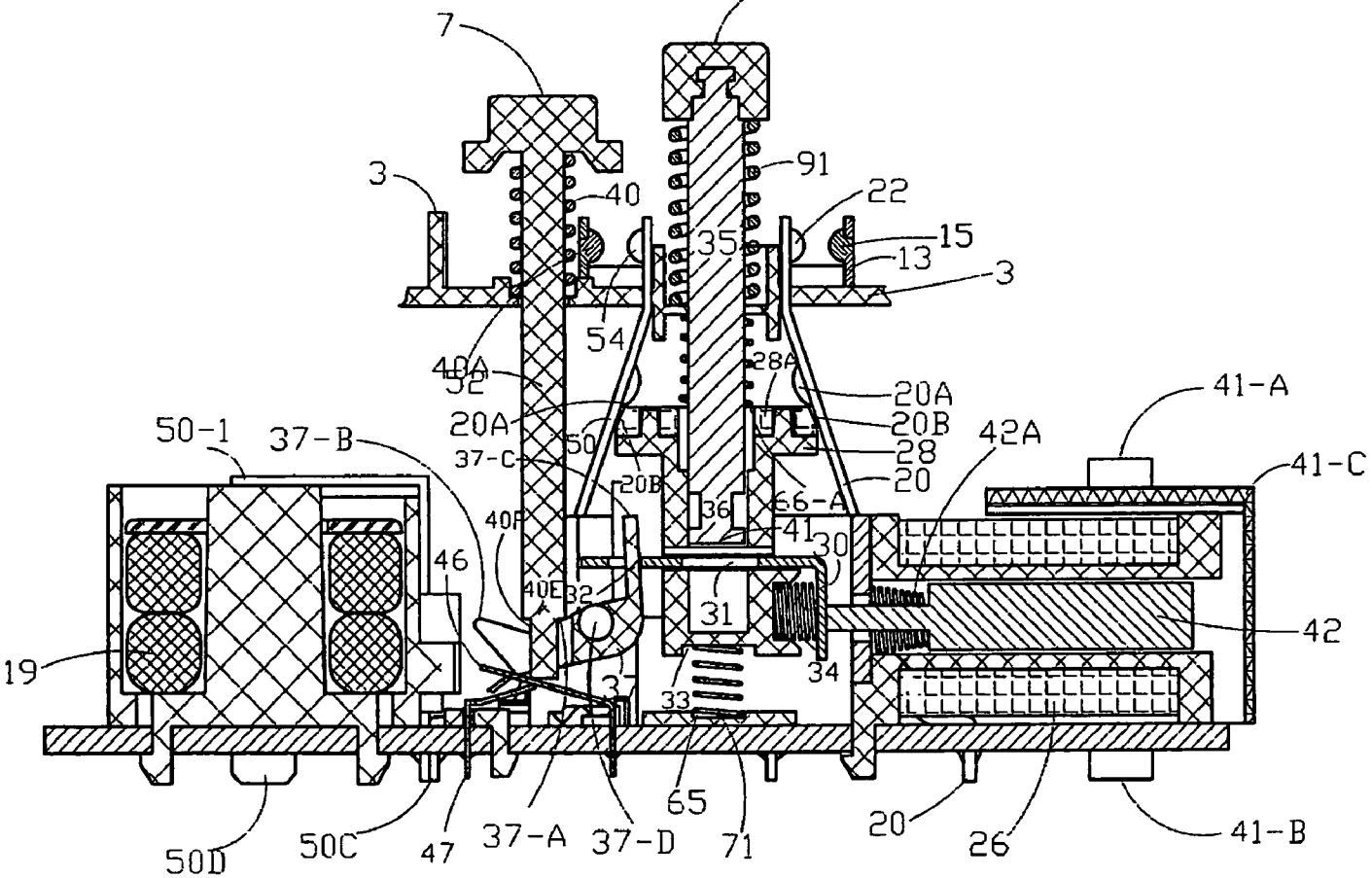
Figures 3, 8:
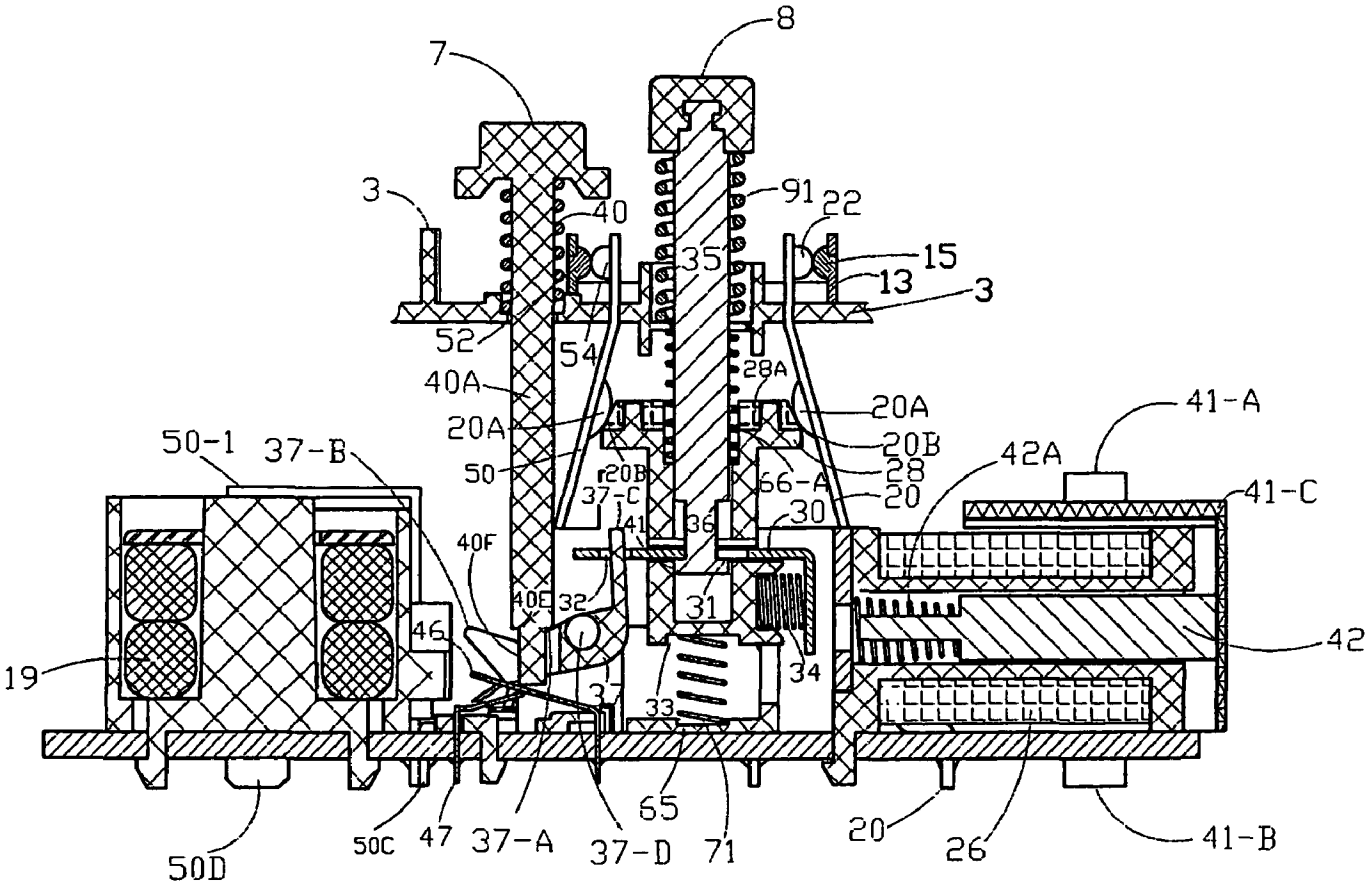
Figures 4, 8:
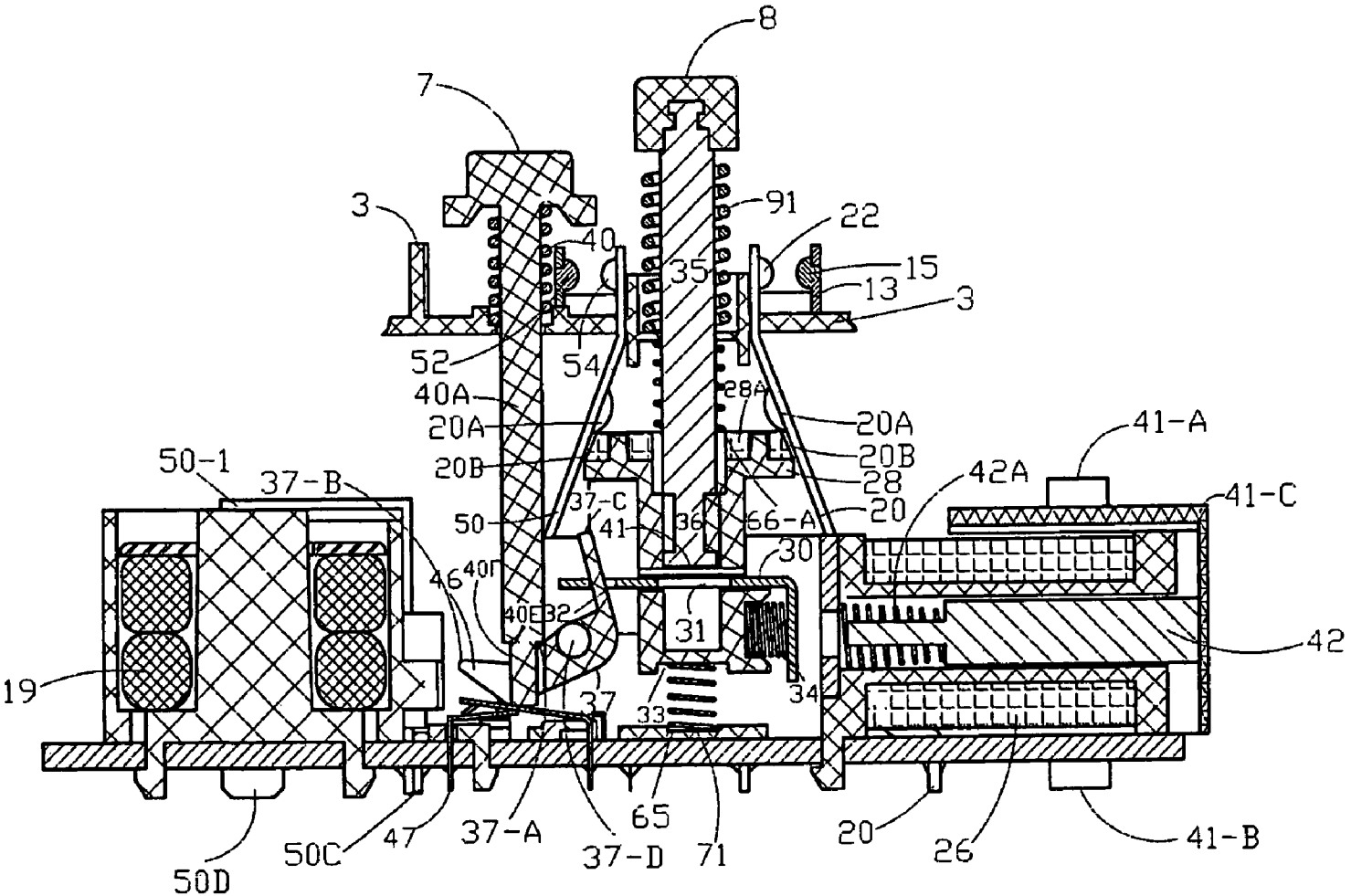

In addition to manual simulation of a leakage current by pressing the test button TEST to detect whether the GFCI device has come to the end of its life, the GFCI device also incorporates a forcible mechanical release to cut off the power output. As shown in FIG. 8-2, when the test button 7 is pressed down to its first position, flexible metal switch pieces 46 and 47 comprising test switch KR-5 come into contact to manually generate a simulated leakage current. If the GFCI device works normally with its protective features intact, the mechanical tripping device should act. That is, locking member 30 acts so that reset button 8 is released, cutting off power output of the GFCI device. If after test button 7 is pressed down from a static state to the first position, the mechanical tripping device does not act (as shown in FIGS. 8-3 and 9-1), then the GFCI device has come to the end of its life. At this time, as shown in FIGS. 8-4 and 9-2, test button 7 may continue to be pressed down to a second position to forcibly cut off the power output of the GFCI device through a mechanical device. More specifically step 40E of arm 40*a* is pressed on the two sides of the V shaped slot 37-A, causing sliding block 37 to rotate around projections 37-D protruding on its two sides and acting as rotating axles. Through the upwardly inclined handled 37-C of release sliding block 37 that extends into hole 32 on locking member 30, locking member 30 is pulled to move, so that locking slot 36 of reset directional lock 35 jumps out of hole 31 of locking member 30, reset support piece 28A and release 28 drop down at the same time and flexible power line input metal pieces 50 and 51 drop down at the same time. Moving contacts on power input metal pieces 50 and 51 are disconnected from fixed contacts on power output conductors 13 and 14, respectively. Power output conductors 13 and 14 and power output ends 80 and 81 respectively connected to flexible metal pieces 20 and 21 are not energized. Since power output conductors 13 and 14 and power output ends 80 and 81 are not energized, output power from the GFCI device is removed.

When there is a need to detect whether functions of the GFCI device are normal, a user may also press test button TEST to cause the upper ends of flexible metal switches pieces 46 and 47 to come into contact and to become conducted, generating a simulated leakage current, to test whether the GFCI device has come to the end of its life. If the failure of the GFCI device is not eliminated, the mechanical tripping device cannot act, thus preventing the reset button RESET from being reset, and the GFCI device does not have a power output.

In these circumstances, the control signal from pin 5 of control chip IC must be filtered by anti-interference capacitor C5 connected between the control end of the SCR V4 and ground, to suppress any erroneous tripping of the GFCI device.

As shown in FIGS. 11, 5 and 10-1 the GFCI device includes a red reset indicator V5 (R) on circuit board 18 to indicate whether the GFCI device has come to the end of its life. A green or yellow power output indicator V3 (G) is parallelly arranged with the reset indicator V5 (blocked by reset indicator R in FIG. 10-1), to indicate the working status of the GFCI device. The indicators V3 and V5 deflect the light emitted through light guide tube D onto the surface of the GFCI device, so that the indications are visible through status indicator hole 30-A as shown in FIG. 2. When the power input end of the ground fault circuit interrupter is properly connected to the hot power line and neutral line inside the wall, as long as the ground fault circuit interrupter has not come to the end of its life and still has protective functions against a leakage current, reset indicator V5 is lit; if the ground fault circuit interrupter has come to the end of its life, reset indicator V5 is not lit. When ground fault circuit interrupter has not come to the end of its life and has power output, reset indicator V5 goes out and power output indicator V3 is lit; by contrast, when the ground fault circuit interrupter has come to the end of its life and has no power output, reset indicator V5 is lit and power output indicator V3 is not lit. Therefore, the user can determine whether the ground fault circuit interrupter has come to the end of its life and determined its work status by the status of indicators V5 and V3.

Based on the above description, The herein disclosed GFCI device includes the following salient functions:

(1) After the power input end of the GFCI device is properly connected to a power supply, without operating any part, a simulated leakage current can be automatically generated to detect whether the GFCI device still protects functions against any leakage current, that is, whether the GFCI device has come to the end of its life. In addition, the results of this test can be displayed to a user.

When the internal components of the GFCI device are intact and reset indicator is lit, it indicates that a proper reset mechanism can be automatically set up and reset is possible. After a reset, the reset indicator is not lit and the power output indicator is lit, indicating that the GFCI device can work normally;

When the internal components of the GFCI device have an open or short circuit, that is, when they come to the end of their lives, the reset indicator does not come on, indicating that the GFCI device has come to the end of its life and preventing the reset button from being reset, thus, the GFCI device's load output end and the single phase, three line power output on the surface of the interrupter do not have any power output.

(2) When components inside the GFCI device, especially the solenoid coil, fail, that is when the device has come to the end of their lives, the GFCI device can be forcibly tripped/released by mechanical means, thus forcibly cutting off its power output and causing the ground fault circuit interrupter that has come to the end of its life not to be able to be reset.

(3) When an electric leakage current is generated by manual simulation and the GFCI device can be tripped/released, the reset indicator is lit, indicating that the GFCI device can work normally and can be reset. After the reset, the reset indicator goes out and the power output indicator is lit. When a leakage current is generated by manual simulation and the GFCI device cannot be tripped/released, the reset indicator is not lit, which indicates that the GFCI device has come to the end of its life. At this time the GFCI can be forcibly tripped/released by mechanical means. After it is tripped, the GFCI device can prevent the reset button from being reset, thus causing the load output end of the GFCI device and the single phase, three line power output on the surface of the GFCI device not to have power output.

(4) When an installer or electrician erroneously connects the power line inside the wall to the power output end of the GFCI device, as indicated in FIG. 11 and FIG. 12, without operating any part, the GFCI device generate a leakage current that the circuit that generates simulated electric leakage current cannot generate. Electric leakage current detection chip IC cannot generate a control signal, SCR V4 cannot conduct, no electric current flows through the solenoid coil SOL, no magnetic field can be generated to push its built-in iron core to act to disable the mechanical tripping apparatus, and the mechanical release apparatus cannot act, thus automatically preventing the reset button from being reset. The GFCI device does not have power output. The reset indicator is not lit, indicating a wiring error. It is only when the installer properly connects the lines that the reset indicator will be lit, the reset button can be reset and the power output end of the GFCI device will have power output.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

What is claimed is:

1. A circuit interrupting device including a base, an inner support and an upper cover containing a line side connection to an input power source, a load side connection to an output end, and an output connection to a user accessible load end; the device comprising:

a pair of power output conductors extended to electrically connect to said user accessible load end;

a first pair of flexible metal pieces; wherein an end of each of said first pair of flexible metal pieces is obliquely connected to a printed circuit board and further electrically connected to a metal piece, which is electrically connected to said input power source; wherein another end of each of said first pair of flexible metal pieces is connectable/disconnectable to each of said pair of power output conductors;

a second pair of flexible metal pieces; wherein an end of each of said second pair of flexible metal pieces is electrically connected to said output power end; wherein another end of each of said second pair of flexible metal pieces is connectable/disconnectable to each of said pair of power output conductors; wherein said circuit interrupting device further comprises a tripping mechanism located underneath a reset button comprising a reset support piece and a tripping device; and each of said first flexible metal pieces and said second flexible metal pieces having a first side and an opposite second side extending between and orthogonally to the upper cover and the printed circuit board; wherein each of the flexible metal pieces have a fixed end attached to the printed circuit board and a free end extending away from the printed circuit board and towards the upper cover; electrical contacts facing away from each other attached to the first sides and to the free ends of the flexible metal pieces; semicircular protruding pieces which allow each of said first flexible metal pieces and said second flexible metal pieces to sit securely on said reset support piece attached to the second sides of the flexible metal pieces between the contacts and the fixed ends facing the reset support piece and each other;

whereby an electrical continuity is established or discontinued when said first pair of flexible metal pieces is connecting/disconnecting to said pair of power output conductors, and said second pair of flexible metal pieces is connecting/disconnecting to said pair of power output conductors.

2. The circuit interrupting device according to claim 1, wherein each of said pair of power output conductors comprises a pair of fixed contacts; wherein each of said first pair of flexible metal pieces has a movable contact which is capable of connecting/disconnecting to each of said fixed contacts on said pair of power output conductors; and wherein each of said second pair of flexible metal pieces has a movable contact which is capable of connecting/disconnecting to each of said fixed contacts on said pair of power output conductors.

3. The circuit interrupting device according to claim 1, wherein said metal piece passes through a differential transformer.

4. The circuit interrupting device according to claim 3, wherein said metal piece is U-shaped.

5. The circuit interrupting device according to claim 1, wherein said circuit interrupting device is a ground fault circuit interrupter.

6. The circuit interrupting device according to claim 1, wherein said reset support piece is located above said tripping device; wherein said reset support piece provides supports for said first and said second pairs of flexible metal pieces; and wherein said tripping device moves with said reset button.

7. The circuit interrupting device according to claim 1, wherein said reset support piece is shaped like a "I-shaped", where a top dimension of said reset support piece is smaller than a bottom dimension.

8. The circuit interrupting device according to claim 1, wherein each of said reset support piece and said tripping device containing a through hole which is aligned to allow a directional lock from underneath said reset button to pass through.

9. The circuit interrupting device according to claim 8, wherein said directional lock is capable of passing through a hole in a locking member when said reset button is depressed to allow a solenoid coil to energize so as to reset said circuit interrupting device.

10. The circuit interrupting device according to claim 1, wherein said pair of fixed contacts on each of said pair of output conductors is perpendicular to said power output conductors.

11. The circuit interrupting device according to claim 1, further comprising a reset status light that lights when said device is capable of being reset; and a power status light that lights to indicate that said device has power output.

12. The circuit interrupting device according to claim 1, further comprising a simulated leakage current generating switch (KR-1) comprising:

a first switch piece;

a second switch piece; and a third switch piece;

wherein when said circuit interrupting device is properly wired and in a tripped state, said first switch piece is in contact with said second switch piece, which automatically generates said simulated leakage current which is capable of testing components of said circuit interrupting device.

13. The circuit interrupting device according to claim 12, wherein said first switch piece is in series with a resistor which is electrically connected to a neutral line of said input power source; wherein said first switch piece has a contact located at an upper end of said first switch piece;

wherein said second switch piece is electrically connected to a hot line of said input power source via a solenoid coil; wherein said second switch piece has two contacts located at an upper and a lower ends of said second switch piece;

wherein a third switch piece which is electrically connected to said neutral line of said input power source through a silicon controlled rectifier (SCR); wherein said third switch piece has a contact located at a lower end of said third switch piece.

14. The circuit interrupting device according to claim 12, wherein said first, second, and third switch pieces are located next to a tripping device beneath said reset button; and wherein said first, second, and third switch pieces are triangularly arranged with said first switch piece located at the bottom; said second switch piece situated in the middle; and said third switch piece located at the top.

15. The circuit interrupting device according to claim 12, wherein said components of said circuit interrupting device comprises SCR and solenoid coil.

16. The circuit interrupting device according to claim 15, whether said components further comprises a differential transformer and a leakage current detection IC chip.

17. The circuit interrupting device according to claim 1, further comprising a reset switch (KR-4) which is located below a reset button;

wherein said reset switch comprises a flexible metal piece and an electric contact;

wherein when said reset button is in a tripped state, said flexible metal piece and said electric contact do not come into contact so that said reset switch is in a disconnected state; and wherein when power lines are properly wired and said reset button is depressed, said flexible metal piece and said electric contact come into contact with each other to allow reset.

18. The circuit interrupting according to claim 17, wherein said reset switch is adapted to coupled to a solenoid coil.

19. The circuit interrupting device according to claim 17, wherein said reset switch is serially connected to a simulated leakage current generating switch comprising:

a first switch piece in series with a resistor which is electrically connected to a neutral line of said input power source; wherein said first switch piece has a contact located at an upper end of said first switch piece;

a second switch piece which is electrically connected to a hot line of said input power source via a solenoid coil; wherein said second switch piece has two contacts located at an upper and a lower ends of said second switch piece;

a third switch piece which is electrically connected to said neutral line of said input power source through a silicon controlled rectifier (SCR); wherein said third switch piece has a contact located at a lower end of said third switch piece;

wherein when said circuit interrupting device is properly wired and in a tripped state, said contact at said upper end of said first switch piece is in contact with said contact at said lower end of said second switch piece, which automatically generates said simulated leakage current to test components of said circuit interrupting device.

20. The circuit interrupting device according to claim 1, further comprising a dual-function test button which provides a manual test of components of said circuit interrupting device when a first-level test button is depressed, and provides a mechanical tripping mechanism when a second-level test button is depressed;

wherein said test button has an arm extended downward to connect to a sliding block and a test switch (KR-5);

wherein said test switch comprises a first flexible metal switch piece and a second flexible metal switch piece;

wherein when said interrupting device is powered and in a reset state, a depression of said test button at said first-level causes said test switch to be activated to manually test said components of said interrupting device;

wherein when said circuit interrupting device is not properly wired and in a reset state, a depression of said test button at said second-level allows said sliding block to rotate to manually cause said circuit interrupting device to trip.

21. The circuit interrupting device according to claim 20, wherein one end of said first flexible metal switch piece of said test switch is electrically connected to a hot power output end and the other end is suspended in the air;

wherein one end of said second flexible metal switch piece of said test switch is electrically connected to a neutral power input end through a resistor, and the other end is suspended in the air;

whereby when said test button is depressed, said first flexible metal switch piece is in contact with said second flexible metal switch piece to initiate a test of said circuit interrupting device.

22. The circuit interrupting device according to claim 20, wherein one end of said first flexible metal switch piece of said test switch is electrically connected to a neutral power output end and the other end is suspended in the air;

wherein one end of said second flexible metal switch piece of said test switch is electrically connected to a hot power input end through a resistor, and the other end is suspended in the air;

whereby when said test button is depressed, said first flexible metal switch piece is in contact with said second flexible metal switch piece to initiate a test of said circuit interrupting device.

23. The circuit interrupting device according to claim 20, wherein said sliding block has a pair of protrusions on two sides that act as rotating axles.

24. The circuit interrupting device according to claim 20, wherein said sliding block has a handle which is adapted to connect to a locking member of a tripping device in connection with a reset button.

25. The circuit interrupting device according to claim 24, wherein a manual depression of said second-level of said test button causes said sliding block to mechanically move said locking member so as to mechanically trip said circuit interrupting device.

* * * * *